US006729711B1

(12) United States Patent
Hashimoto et al.

(10) Patent No.: US 6,729,711 B1
(45) Date of Patent: May 4, 2004

(54) INK JET RECORDING APPARATUS

(75) Inventors: Kenichiro Hashimoto, Yokohama (JP); Jiro Moriyama, Kawasaki (JP); Hiroshi Sugiyama, Yokohama (JP); Isao Ebisawa, Yokohama (JP); Hisao Yaegashi, Kawasaki (JP); Toshiharu Inui, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/565,446

(22) Filed: May 5, 2000

Related U.S. Application Data

(62) Division of application No. 08/855,282, filed on May 13, 1997, now Pat. No. 6,137,503, which is a continuation of application No. 08/248,158, filed on May 24, 1994, now abandoned.

(30) Foreign Application Priority Data

May 26, 1993 (JP) ..... 5-124238
Jul. 8, 1993 (JP) ..... 5-169003
Sep. 20, 1993 (JP) ..... 5-233474

(51) Int. Cl.[7] ..... B41J 29/393

(52) U.S. Cl. ..... 347/19; 347/7; 347/86; 250/577

(58) Field of Search ..... 347/19, 7, 85, 347/86, 5, 14, 23; 250/577, 903; 73/291; 116/227

(56) References Cited

U.S. PATENT DOCUMENTS 4,246,489 A 1/1981 Yoshida et al. ..... 250/577
4,313,124 A 1/1982 Hara ..... 347/57
4,345,262 A 8/1982 Shirato et al. ..... 347/10
4,459,600 A 7/1984 Sato et al. ..... 347/47
4,463,359 A 7/1984 Ayata et al. ..... 347/56
4,558,333 A 12/1985 Sugitani et al. ..... 347/65
4,608,577 A 8/1986 Hori ..... 347/66

(List continued on next page.)

FOREIGN PATENT DOCUMENTS

DE 003908548 A1 * 10/1989 ..... 250/361
EP 0 418 828 3/1991
EP 0 440 110 8/1991
EP 0 452 585 10/1991
EP 0 486 309 5/1992
EP 0 573 274 12/1993
FR 2 492 974 4/1982

(List continued on next page.)

*Primary Examiner*—Shih-Wen Hsieh
(74) *Attorney, Agent, or Firm*—Fitzpatrick, Cella, Harper & Scinto

(57) ABSTRACT

An ink jet recording apparatus comprises a carriage movable in a given direction with a recording head which is detachably mountable on it and provided with discharge ports for discharging liquid. The apparatus is arranged to include a sensor for detecting the presence or absence of the carriage, the recording head, and at least one of the ink containers. This sensor is provided for the main body of the apparatus and positioned within the movable range of the carriage. With this arrangement, it is possible to simplify the structure required for detecting whether or not these vital elements for recording are installed without any auxiliary power-supply or memory means.

27 Claims, 25 Drawing Sheets

U.S. PATENT DOCUMENTS

| | | | | | |
|---|---|---|---|---|---|
| 4,723,129 | A | | 2/1988 | Endo et al. | 347/56 |
| 4,739,847 | A | * | 4/1988 | Terasawa | 177/140 |
| 4,740,796 | A | | 4/1988 | Endo et al. | 347/56 |
| 4,788,444 | A | | 11/1988 | Williams | 250/577 |
| 4,847,638 | A | | 7/1989 | Moriyama | 347/14 |
| 4,970,533 | A | | 11/1990 | Saito et al. | 347/49 |
| 4,998,022 | A | | 3/1991 | Tregay | 250/577 |
| 5,027,134 | A | * | 6/1991 | Harmon et al. | 347/29 |
| 5,168,291 | A | * | 12/1992 | Hiramatsu et al. | 347/19 |
| 5,250,957 | A | | 10/1993 | Onozato | 347/7 |
| 5,289,210 | A | * | 2/1994 | Takayanagi | 347/14 |
| 5,291,224 | A | | 3/1994 | Asano et al. | 346/134 |
| 5,382,969 | A | | 1/1995 | Mochizuki et al. | 347/23 |
| 5,475,404 | A | * | 12/1995 | Takahashi et al. | 347/23 |
| 5,534,899 | A | | 7/1996 | Uchikata et al. | 347/49 |
| 5,616,922 | A | | 4/1997 | Reffner et al. | 250/339.12 |
| 5,616,929 | A | * | 4/1997 | Hara | 250/573 |
| 5,617,122 | A | * | 4/1997 | Numata et al. | 347/14 |
| 5,638,097 | A | | 6/1997 | Takayanagi et al. | 347/7 |
| 6,012,795 | A | | 1/2000 | Saito et al. | 347/7 |
| 6,024,428 | A | * | 2/2000 | Uchikata | 347/7 |

FOREIGN PATENT DOCUMENTS

| | | | | |
|---|---|---|---|---|
| JP | 54-56847 | | 5/1979 | |
| JP | 59-123670 | | 7/1984 | |
| JP | 60-071260 | | 4/1985 | |
| JP | 60-172546 | | 9/1985 | |
| JP | 61-249761 | | 11/1986 | |
| JP | 362021549 | A * | 1/1987 | 347/7 |
| JP | 62-60680 | | 3/1987 | |
| JP | 62-156963 | | 7/1987 | |
| JP | 62-246740 | | 10/1987 | |
| JP | 63-147650 | | 6/1988 | |
| JP | 63-252747 | | 10/1988 | |
| JP | 2-102061 | | 4/1990 | |
| JP | 5-8383 | | 1/1993 | 347/49 |
| JP | 5-31915 | | 2/1993 | |
| JP | 6-47985 | | 2/1994 | |
| JP | 59-138461 | | 8/1994 | |
| WO | WO 88/04610 | | 6/1988 | |

* cited by examiner

INK JET RECORDING APPARATUS

This application is a divisional application of U.S. patent application Ser. No. 08/855,282, filed May 13, 1997 now U.S. Pat. No. 6,137,503, which is a continuation application of U.S. patent application Ser. No. 08/248,158, filed May 24, 1994, abandoned.

BACKGROUND OF THE INVENTION

1. Field of the Invention

The present invention relates to an ink jet recording apparatus for recording characters and images by discharging fine ink droplets onto a sheet, an OHP sheet, a cloth, or other recording medium. Particularly, the invention relates to an ink jet recording apparatus in which at least either one of a recording head and an ink tank is detachably installed on a carriage.

2. Related Background Art

There has been known an ink jet recording apparatus for recording by discharging fine ink droplets. This apparatus is advantageous over the apparatuses of other types because of its higher recording speed, easier recording in color, capability of recording not only on a regular sheet, but also on a cloth or other media, a lesser noise, and a higher quality among other features.

In general, the recording head of an ink jet recording apparatus has ink discharging ports of one to approximately 200 or 1,000 to approximately 2,000 in order to record on the entire recordable area, while allowing the head to scan a recording medium correlatively. The main scan is such that the carriage on which the recording head is mounted reciprocates to scan for the correlative movement. The subscan is such that a recording medium is scanned in one way in relation to the recording head. Here, the recording head mounted on the carriage is arranged detachably from the carriage or an ink tank which contains ink to be supplied to the recording head is arranged detachably from the recording head.

In the former arrangement, the recording head is replaced with a normal one for use if any malfunction takes place in the head or replaced with a new one completely when ink is finished in case of a recording head being arranged integrally with an ink tank.

In the latter arrangement, only the ink tank can be replaced with a new ink tank for use while the recording head remains unchanged when ink is finished. However, since the head or the ink tank or both are detachably mounted on the carriage, whether or not the recording head or the ink tank is installed correctly must be examined manually by the user or automatically by the apparatus itself for confirmation when executing a recording operation.

An examination of the kind by a user tends to be incomplete, while the automatic examination by a recording apparatus requires a sensor on the carriage. The sensor should be capable of transducing each event of the installation of a recording head or an ink tank into electrical signals, and transmitting them to the main body of the recording apparatus through flexible cables in order to make the required confirmation, and determine whether or not the installation is correctly carried out.

However, according to the above-mentioned conventional technique, there is a need for a considerable size of space for the arrangement of the flexible cables, which tends to make the size of the apparatus larger inevitably. Also, the use of durable cables results in a higher cost. Therefore, it is advisable to avoid any provision of flexible cables for the transmission of the electrical signals or it is advisable to minimize the number of cables for this transmission.

Also, if a sensor must be mounted on the carriage, the weight of the movable unit becomes heavier that much, necessitating the power of the motor for driving the carriage to be increased accordingly. Further, it take a longer time for the carriage to arrive at a constant speed. As a result, not only the recording speed is reduced, but also, a problem is encountered in that the apparatus should be made larger to the extent that the traveling distance of the carriage is made longer.

Also, among such ink jet recording apparatuses, there has been known an apparatus which is arranged to detachably install an ink cartridge in the main body of the apparatus or on a carriage as a source of ink supply so that the provision of ink can be made easily along with the consumption of ink for recording. An ink cartridge of the kind is replaced manually by the operator for use.

Further, there has been known an apparatus which is arranged to provide a function to prompt the operator to replace ink cartridges by detecting the ink remains when such an ink cartridge as above is used.

However, in the above-mentioned ink cartridge, it is technically difficult to detect the ink remains exactly. Also, the costs are extremely high if such a detection should be adopted. With a view to solving the problem, therefore, a method is proposed for detecting the ink remains in such a manner that the number of ink discharges from the head is counted, and the counted number is stored in a memory arranged in the main body of the apparatus, thus giving a warning when the stored number reaches a predetermined number of ink discharges. To effectuate this method, it is also necessary to reset the counter arranged for storing the counted number of ink discharges in the main body of the apparatus each time the ink cartridge is replaced. In this case, a switch and a detector for detecting the attachment and detachment of an ink cartridge must be provided. If the required resetting should be carried out by switching, it results not only in an additional cost, but also, in the operations imposed up the operator to execute such as depressing a start key and a reset key in addition to the replacement of the ink cartridges itself. This requires a considerable amount of work on the part of the operator. Also, the cost is inevitably increased by the additional provision of the detector.

Moreover, the flow of ink in the ink jet head or in the ink supply pipe should be interrupted when the ink cartridges are replaced. It is then necessary to exercise an extra suction from the ink discharge surface in order to fill ink in the ink passages up to the ink discharge ports.

As described above, there is a need for resetting the counter as well as exercising the extra suction when ink cartridges are replaced in a conventional ink jet recording apparatus. Also, it is necessary to detect whether or not the ink cartridge is installed correctly before these extra operations are performed.

Here, in a thermal transfer serial printer, it has been known traditionally that a structure is arranged for detecting the position of a carriage, the information regarding an ink ribbon cassette, and the end of the ink ribbon in it by use of an optical sensor provided in the home position for detecting a discriminating portion given to the carriage, a discriminating portion given to the ink ribbon cassette, and a window arranged for detecting the end of the ink ribbon (as disclosed in Japanese Patent Laid-Open Application No. 62-60680, for example).

In the thermal transfer printers, there is no possibility that the thermal head is damaged even if no ink ribbon cassette is mounted on the carriage or a printing is erroneously carried out in a state where the ink ribbon in the ink ribbon cassette is used up.

In an ink jet recording apparatus, however, there are some cases where the recording head itself should be replaced if the recording head is driven without mounting an ink cartridge or with an ink cartridge but having no ink in it (or with an ink tank which is formed with a recording head to provide an integrated unit, but having no ink in it), because the air and bubbles are mixed in the fine ink discharge ports or ink passages, thus inviting the disabled discharge of ink from the recording head. Also, in a recording head which discharges ink by use of thermal energy, the heater units may be damaged due to excessive heat in such cases. Therefore, in an ink jet recording apparatus, a technique required for detecting the presence or absence of an ink cartridge on a carriage or of the ink remains in the cartridge is vital to the life of the recording head. Particularly, in consideration of the current technical tendency which results in more frequent replacements of ink containers because of the prolonged life of the head itself, necessitating the replacement of the ink containers more often or in the adoption of a smaller ink container along the miniaturization of the apparatus itself, which also necessitates the replacement of the ink containers more often, the above-mentioned detection technique becomes increasingly more important in recent years.

SUMMARY OF THE INVENTION

With a view to solving the problems associated with the conventional technique as described above, it is an object of the present invention to provide an ink jet recording apparatus capable of easily detecting whether or not ink (or some other liquid) to be discharged from an ink jet recording head is available on a carriage.

It is another object of the present invention to provide an ink jet recording apparatus capable of easily detecting the presence or absence of an ink container on a carriage or the presence or absence of ink remains in the ink container.

It is still another object of the present invention to provide an ink jet recording apparatus capable of verifying the replacement of the cartridges by a simply structured inexpensive means without the provision of any auxiliary power-supply, data storage, and the like.

It is a further object of the present invention to provide an ink jet recording apparatus capable of detecting the presence or absence of the ink cartridge by an inexpensive means whereby to solve the problems associated with the conventional technique, and also, obtaining the confirmation of the resetting of a counter for the number of ink discharges and the recovery of the recording head, which are executed after the installation of the ink cartridge.

It is still a further object of the present invention to provide a small ink jet recording apparatus by use of a small motor for driving the carriage.

It is another object of the present invention to provide an ink jet recording apparatus having a carriage movable in a given direction with a recording head which is detachably mountable on it and provided with discharge ports for discharging liquid. This apparatus is arranged to include a sensor for detecting the presence or absence of at least one of the carriage, the recording head, and the ink container. This sensor is provided for the main body of the apparatus and positioned within the movable range of the carriage.

DETAILED DESCRIPTION OF THE PREFERRED EMBODIMENTS

Hereinafter, with reference to the accompanying drawings the detailed description will be made of the embodiments according to the present invention.

Figure 1:
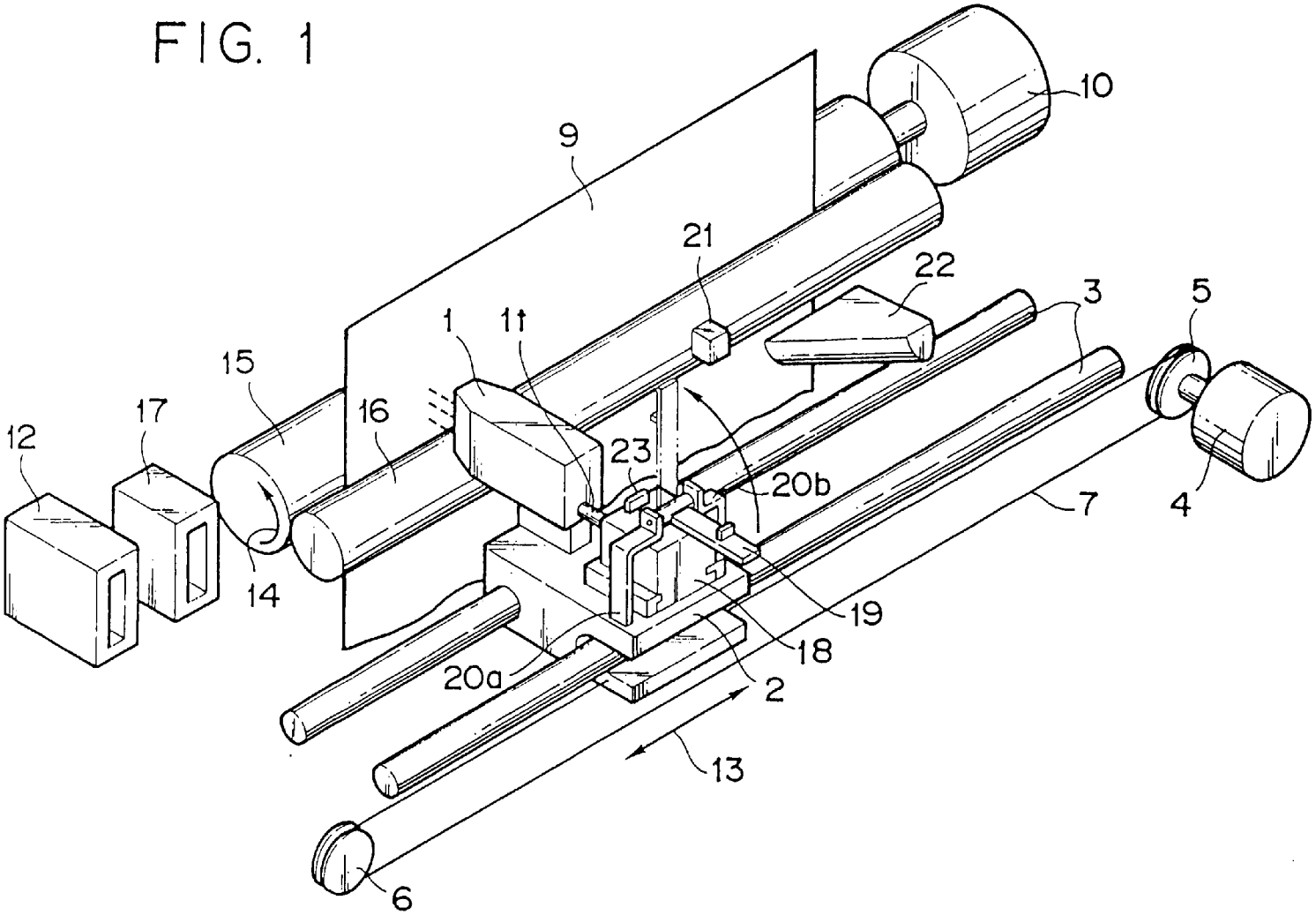
FIG. 1 is a perspective view schematically showing an ink jet recording apparatus according to an embodiment of the present invention.
Figure 2:
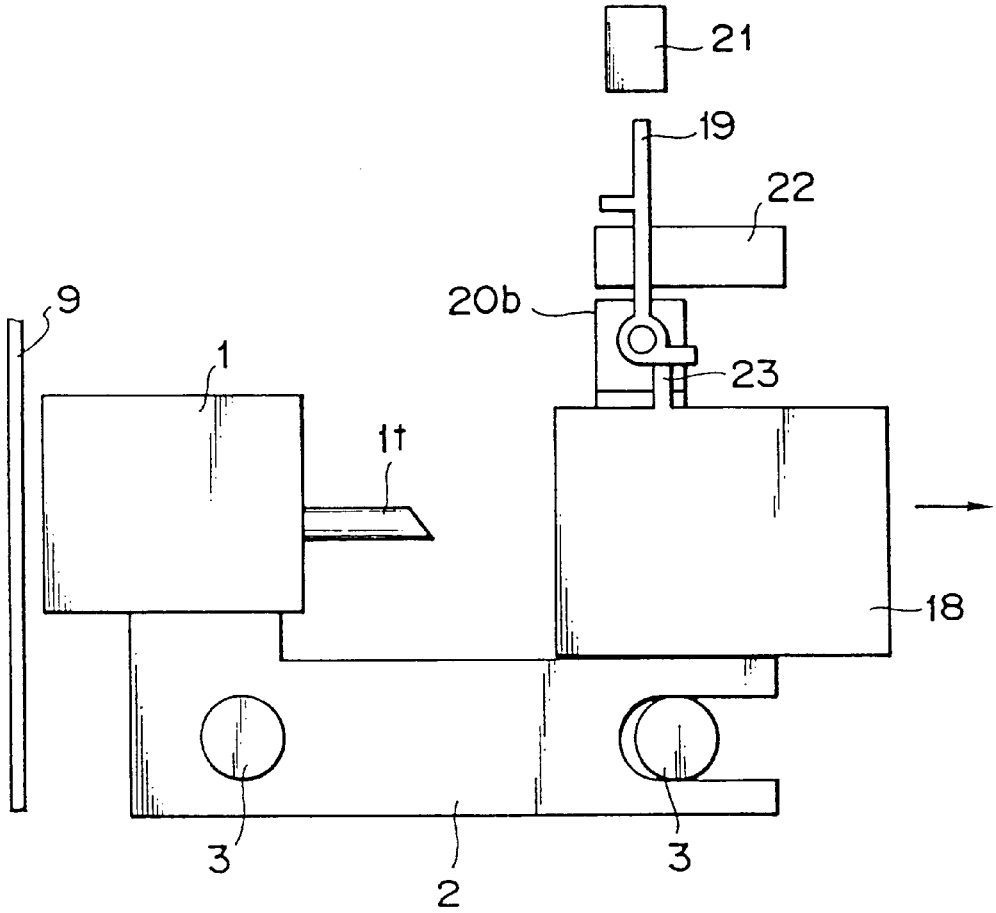
FIG. 2 is a cross-sectional view schematically showing the ink jet recording apparatus represented in FIG. 1.
Figure 3:
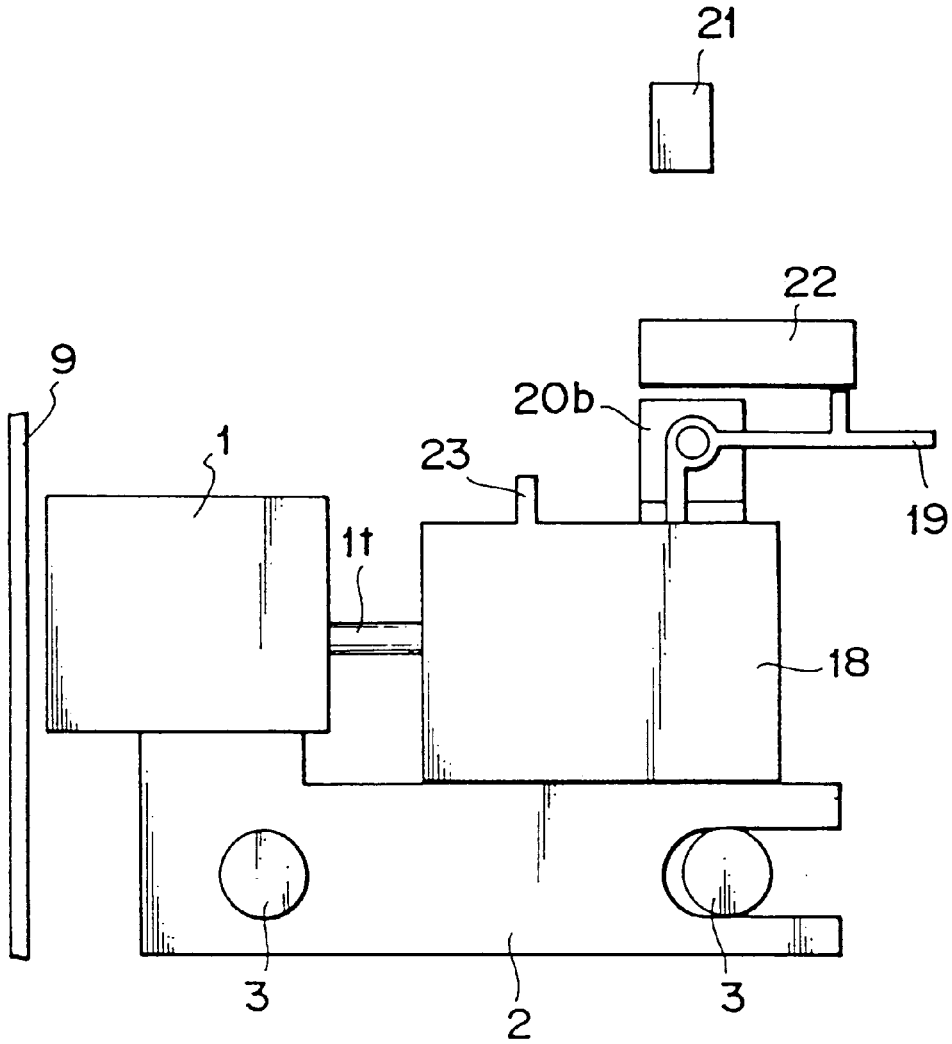
FIG. 3 is a cross-sectional view schematically showing the ink jet recording apparatus represented in FIG. 1.

FIG. 1 is a perspective view schematically showing an ink jet recording apparatus according to an embodiment of the present invention. FIG. 2 and FIG. 3 are cross-sectional views showing the ink jet recording apparatus represented in FIG. 1.

Figure 6:
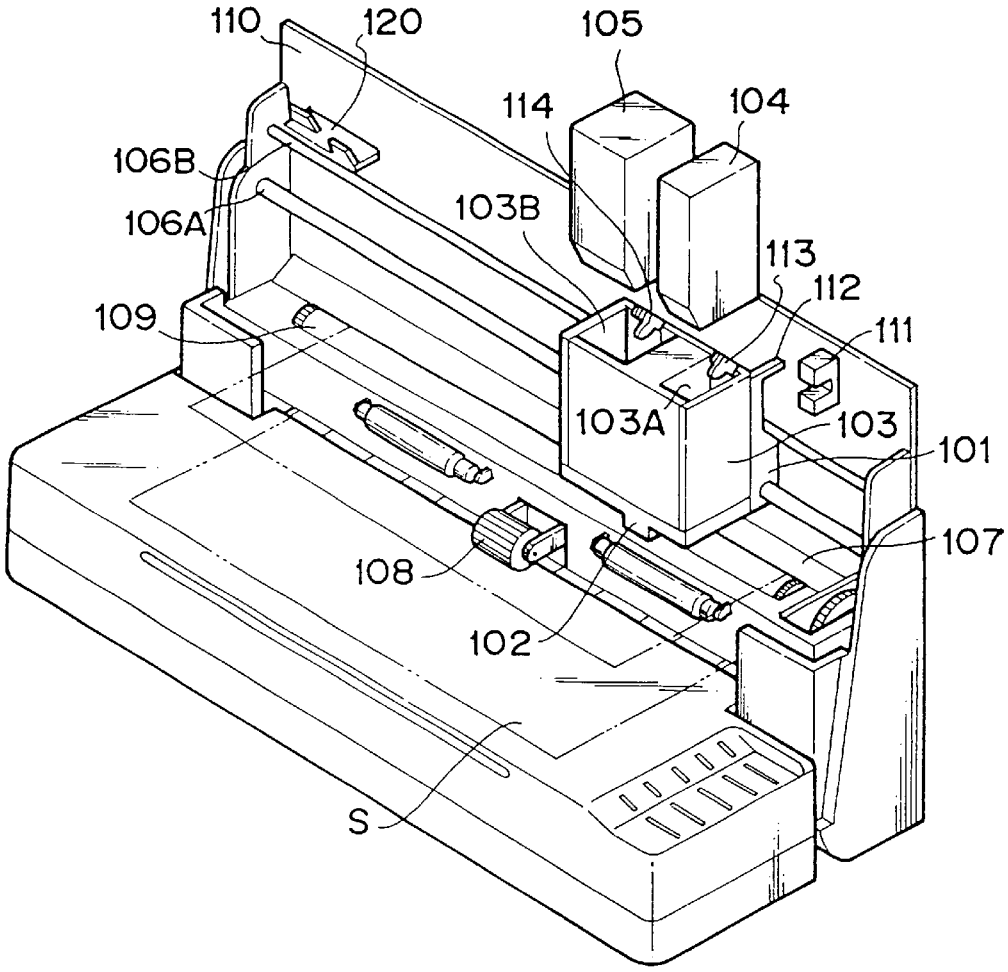
FIG. 6 is a perspective view schematically showing the structure of another embodiment according to the present invention.

In FIG. 1 to FIG. 3, the same reference characters are applied to the same elements as those appearing in FIG. 6, and the descriptions thereof will be omitted.

In FIG. 1, a reference numeral 23 designates a piece extruding from an ink cartridge 18; 20*a* and 20*b*, the supporting members which are arranged on both ends of a carriage 2 in the main scanning direction, respectively; and 19, a flag-shaped member having a shaft which is coupled to the holes arranged on both sides of the pair of supporting members 20*a* and 20*b* so that this member is rotatively supported by them. This flag-shaped member 19 can stand up by rotating itself 90 degrees so that it can be held in a position indicated by two-dot chain lines in FIG. 1 when one end of the member is pressed by the extruding piece 23.

The flag-shaped member 19 can be held by a frictional force exerted between the supporting members 20*a* and 20*b*, and the rotative shaft of the flag-shaped member 19. Here, a reference numeral 21 designates a sensor for detecting the flag-shaped member 19 when the carriage 2 moves and the flag-shaped member 19 approaches the sensor; and also, 22, a cam for rotating the flag-shaped member 19 along the movement of the carriage 2 in order to push it down in the horizontal direction.

In the above-mentioned ink jet recording apparatus, if an ink cartridge 18 is replaced before starting a printing due to insufficient ink remaining in the ink cartridge 18, the one end of the flag-shaped member 19 is pressed to rotate it to 90 degrees as described above. This member is held in a state as shown in FIG. 2.

Subsequently, when the ink cartridge 18 filled with ink is installed anew in the predetermined position on the carriage 2, the flag-shaped member 19 is still kept in the previous position due to the frictional force described above. It is not pressed backward by the extruding piece 23, either.

Now, when the carriage 2 is moved toward a recording medium 9, the sensor 21 detects the approaching flag-shaped member 19 to notice that the ink cartridge 18 is replaced. Also, by means of the cam 22, the flag-shaped member 19 is rotated to fall down and restore it to the state prior to the replacement of the cartridges as shown in FIG. 1, thus being on standby for the next replacement of the cartridge 18. FIG. 3 illustrates this state.

When the flag-shaped member 19 stands up to enable the sensor 21 to detect the presence of this member, it is verified that the ink cartridge has been replaced. In this case, there is a possibility that the air is mixed with ink as air bubbles when it is allowed to enter from the leading end of an ink tube It. This may result in a disturbed image due to a hitch in the ink supply. In order to avoid this disturbance, a cap 12 is used to cover the recording head 1 for the execution of the suction recovery process to remove the air bubbles. Then the intended recording is started. Also, even in a case that the power from the power-supply is suspended due to the power outage or the like after the replacement of the ink cartridge 18, it is possible to verify that the ink cartridge 18 has been replaced because the flag-shaped member 19 still remains stood up.

After the discharge recovery process, the cap 12 is retracted by a driving means (not shown) from the recording head 1. Then the power from a motor 4 is transmitted to the carriage 2 through a wire 7 tensioned around a driving pulley 5 and a driven pulley 6. In this way, the recording head 1 reciprocates in the directions indicated by arrows 13 in FIG. 1. During this period, ink droplets are discharged onto the recording medium 9 for recording. Each time the recording head 1 reciprocates as described above, the recording medium 9 is fed in a given length (equivalent to the arrangement width of the discharge ports, for example). These movements are repeated to execute a recording.

Figure 4:
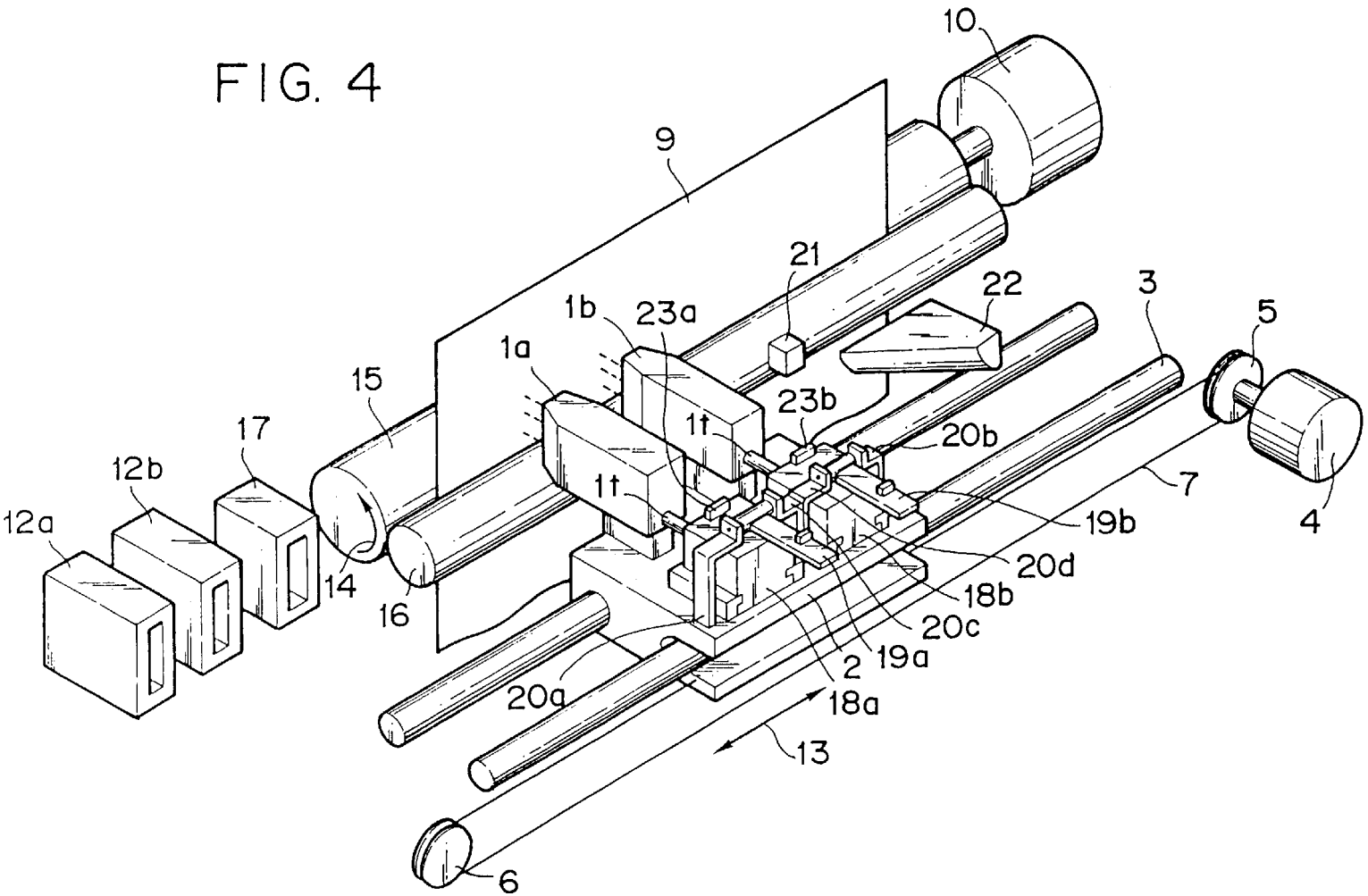
FIG. 4 is a perspective view schematically showing an ink jet recording apparatus according to another embodiment of the present invention.

FIG. 4 is a perspective view showing another embodiment according to the present invention.

In the embodiment 1, there is one recording head, but here, the description will be made of a case where the present invention is applied to an ink jet recording apparatus which uses two recording heads each for a dark ink or light ink, for example.

In the present embodiment, two ink cartridges 18*a* and 18*b* are arranged for the two recording heads 1*a* and 1*b*. The ink cartridges 18*a* and 18*b* are arranged on the carriage 2 in parallel in the main scanning direction. The extruding pieces 23*a* and 23*b*, supporting members 20*a*, 20*b*, 20*c*, and 20*d* are structured to function in the same manner as those in the embodiment 1. Therefore, any detailed descriptions thereof will be omitted. In this respect, reference numerals 12*a* and 12*b* designate caps to cover the discharge port surface of the recording heads 1*a* and 1*b* when the recording heads 1*a* and 1*b* are in the capping position.

In the above-mentioned ink jet recording apparatus, when the used up ink cartridge 18*a* or 18*b* is withdrawn, the flag-shaped member 19*a* or 19*b* is caused to stand up accordingly. Then, such state remains unchanged even after a new ink cartridge is installed.

Subsequently, when the carriage 2 is moved, the sensor 21 detects the approaches of the flag-shaped members 19*b* and 19*a* in that order to verify that the ink cartridges have been replaced.

When the carriage 2 is further moved, the cam 22 presses the flag-shaped members 19*b* and 19*a* correlatively in that order, the flag-shaped members 19*b* and 19*a* are caused to rotate to fall down so that the members are on standby for the next replacement of ink cartridges.

In the present embodiment, it is possible to detect the replacement of ink cartridges in an ink jet apparatus which uses two recording heads 1*a* and 1*b* without any additional provision of the sensor 21 and cam 22 as described above.

Figure 5:
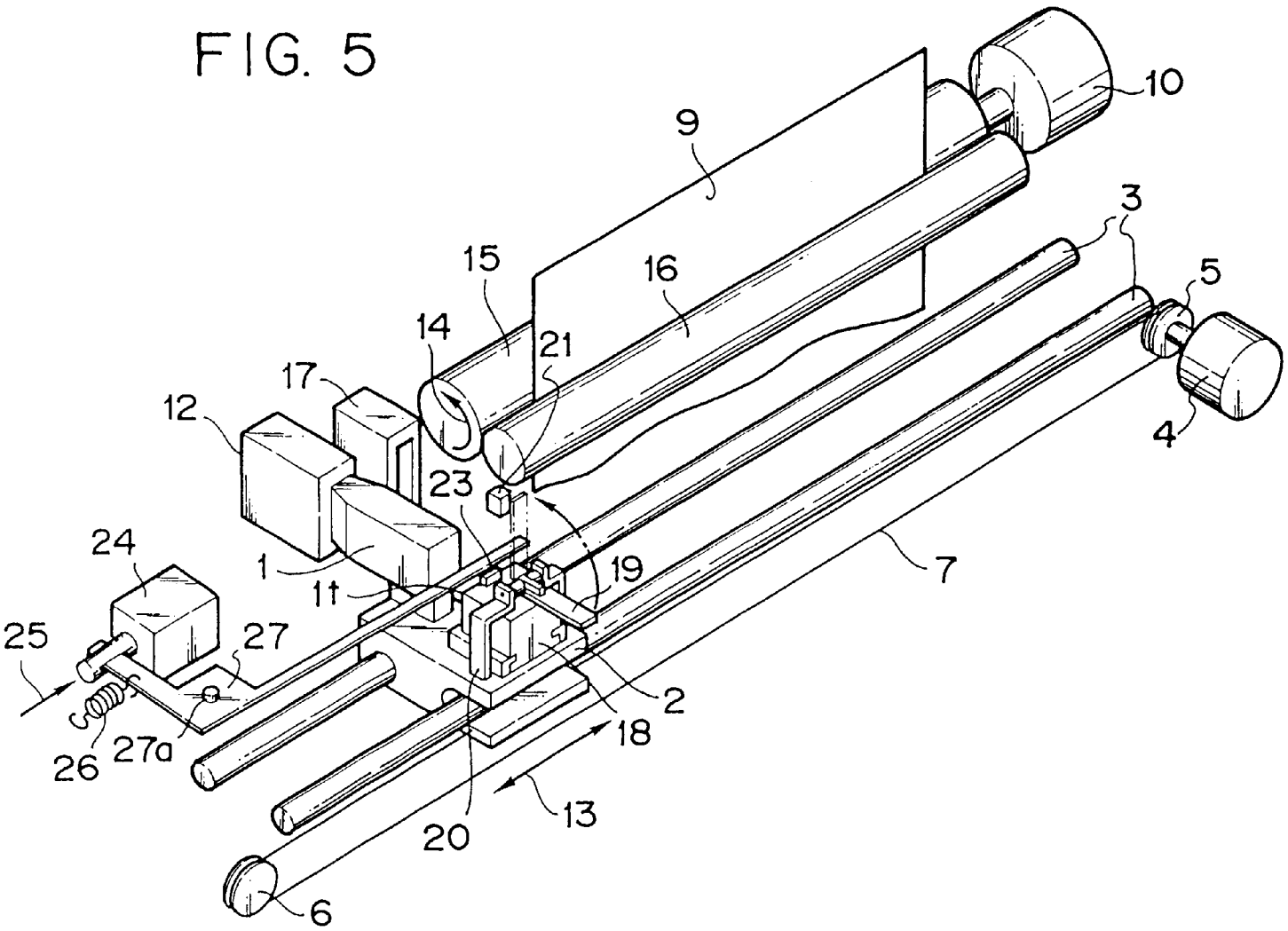
FIG. 5 is a perspective view schematically showing an ink jet recording apparatus according to still another embodiment of the present invention.

FIG. 5 is a perspective view showing still another embodiment according to the present invention.

In the present embodiment, the recording head 1 is in the capping position, and when the head 1 is being capped, that is, the recording head is at rest in the standby position for recording, the flag-shaped member 19 is caused to fall down without any movement of the carriage 2, so that this member is returned to the state where no ink cartridge 18 is replaced. The present embodiment relates to a structure thereby to perform such an operation.

In FIG. 5, a reference numeral 27 designates an arm which presses one end of the flag-shaped member 19 to push it down; and 27*a*, the central shaft for rotatively supporting the arm 27.

A reference numeral 24 designates a solenoid which is coupled to the other end of the arm 27. When a given power is supplied to energize this solenoid 24, a driving force is given to the arm 27.

A reference numeral 25 indicates the direction in which the arm 27 is pulled by the solenoid 24; and 26, a tensioning spring to give a tensioning force to the arm 27 when the solenoid is deenergized.

In the above-mentioned ink jet recording apparatus, when the ink cartridge 18 is replaced, the flag-shaped member is kept standing up as in the embodiment 1. Then as the carriage 2 moves, the sensor 21 detects the approaching flag-shaped member 19 to verify that the ink cartridge 18 has been replaced.

After that, when the carriage 2 is moved to the capping position, the solenoid 24 is energized to rotate the arm 27 by overcoming the biasing force exerted by the tensioning spring 26. In this way, the flag-shaped member 19 is caused to rotate and fall down to be in the state prior to the replacement of the cartridge, thus being on standby for the next replacement of the ink cartridge.

According to the embodiments described above, the flag-shaped member is caused to change its positions from one of the two positions, where the member can be held, to the other when the detachable ink cartridge is removed from the carriage. Also, when a new ink cartridge is installed in this state, the flag-shaped member can maintain its position. Then the flag-shaped member which is in this other position is detected by detection means. In this way, the replacement of ink cartridges is verified.

As a result, the replacement of cartridges can be detected without any additional provision of electrode or the like on each of the ink cartridges. It will suffice if only a minimum operation of removing the air bubbles can be performed after the replacement. Also, only one detection means is good enough for the purpose even when a plurality of ink cartridges are installed.

Also, even if the electricity from the power-supply is suspended after the replacement of the ink cartridges, there is no hitch in detecting the flag-shaped member mechanically without any auxiliary power-supply such as a battery in the recording apparatus, and any means for storing the result of detection in it.

Also, the above-mentioned detection means not only can detect the attachment and detachment of the ink cartridge to the carriage, but also can detect the attachment and detachment of a head for reading a recording head and an original document to the carriage.

Also, according to the above-mentioned embodiments, it is of course possible to obtain excellent printed images by use of the ink jet recording head which will be described in conjunction with FIG. 20.

FIG. 6 is a view showing still another embodiment according to the present invention. In the present embodiment, an example of the serial ink jet recording apparatus is represented. In this example of the apparatus, an ink jet recording head is mounted on a carriage together with an ink cartridge in which a plurality of color inks are stored separately.

Here, a reference numeral 101 designates a carriage; 102, an ink jet recording head having an ink discharge function for discharging a plurality of color inks separately; 103, a cartridge guide which is mounted on the carriage 101 together with the recording head 102; and 104 and 105, the ink cartridges which are detachably held by the cartridge guide 103. In this respect, according to the present embodiment, in one of the ink cartridges 104, black ink is filled in a tank, and in the other one of the ink cartridges 105, ink of three different colors, yellow, magenta, and cyan, are filled in the individual tanks, respectively. From each of the ink tanks, ink of a different color is supplied to each corresponding ink discharge unit of the recording head 102.

Reference numerals 106A and 106B designate the guide shafts for the carriage 101; 107, a pressure plate for holding a sheet S in the recording position; 108, a feed roller to guide the recording sheet S to the recording position; 109, a sheet feed roller capable of feeding the sheet S for a one-line portion each time the recording is made for the one-line portion; 110, an installation frame; and 111, a horizontally U-shaped sensor (means for detecting positions) for detecting the home position which is mounted on the frame. When the carriage 101 is moved along the guide shafts 106A and 106B to the home position (HP) outside the recording area, a fixed piece to be detected (hereinafter referred to as a fixed interrupter) 112, which is arranged to extrude from the carriage 101 to the sensor 111 side, is guided to the recessed portion of the sensor 111. Thus, the beam from a home position sensor formed by a photocoupler of a transmitting type is interrupted so that the home position can be detected, for example.

Figure 7:
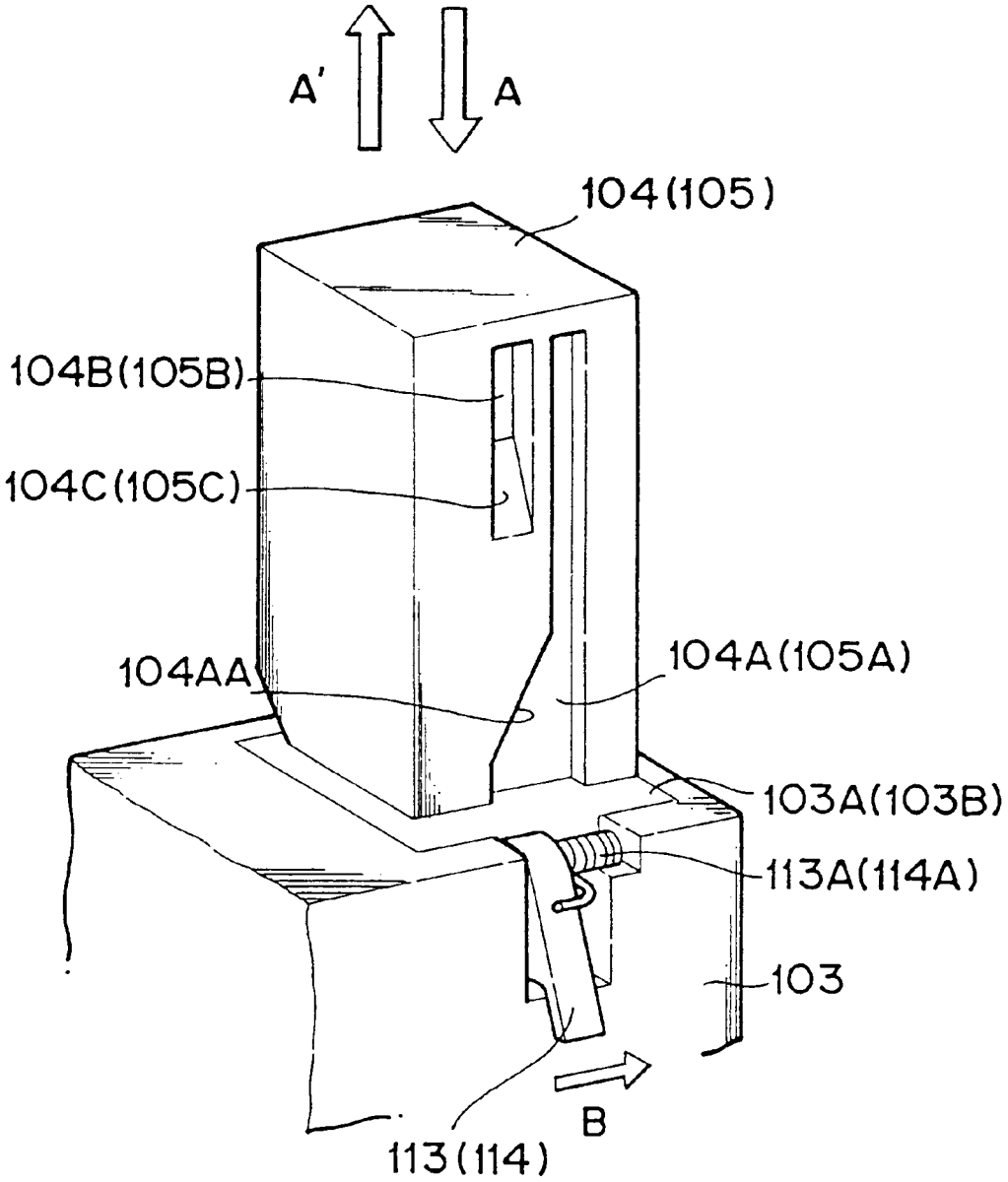
FIG. 7 is a view schematically illustrating the operations of attaching and detaching an ink cartridge in relation to the embodiment represented in FIG. 6.
Figure 8:
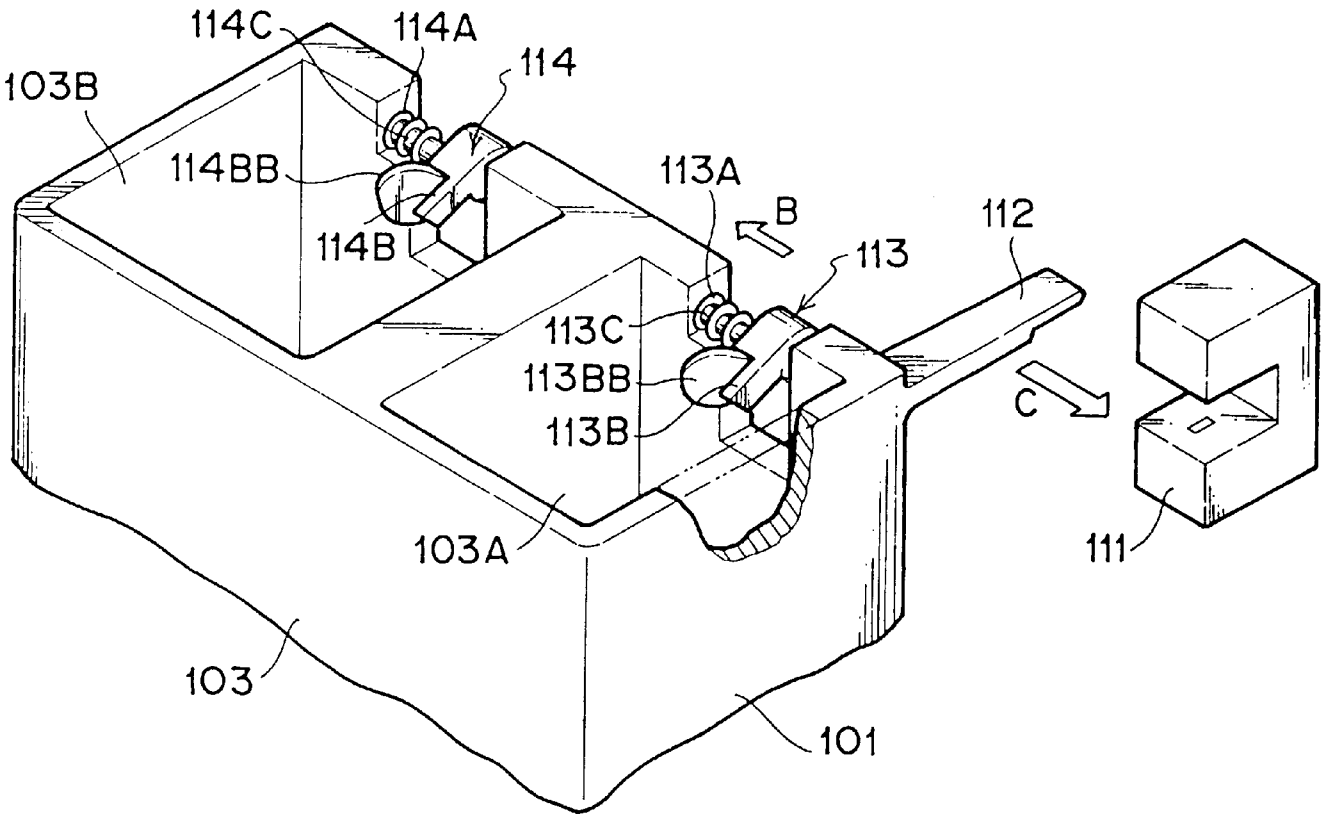
FIG. 8 is a perspective view schematically showing a state-where the ink cartridge is yet to be installed according to the embodiment shown in FIG. 6.

Also, reference numerals 113 and 114 designate the movable pieces of a lever type to be detected (hereinafter referred to movable interrupters) which are arranged on the inlets 103A and 103B of the cartridge guide 103, through which the ink cartridges are inserted. Now, in conjunction with FIG. 7 and FIG. 8, the structures of these movable interrupters 113 and 114 will be described. In other words, these movable interrupters 113 and 114 are structured to be extruded to the sensor 111 side when the ink cartridges 104 and 105 are inserted into the cartridge guide 103 as shown in FIG. 7. Here, reference numerals 113A and 114A designate the springs with which to keep the members 113 and 114 falling down as shown in FIG. 7 when the ink cartridge is not inserted; 113B and 114B, the actuation arms extruding from the members 113 and 114 to the inlets 103A and 103B sides for inserting the ink cartridge as shown in FIG. 8; and 113C and 114C, the supporting shafts which support the members 113 and 114 rotatively.

Figure 9:
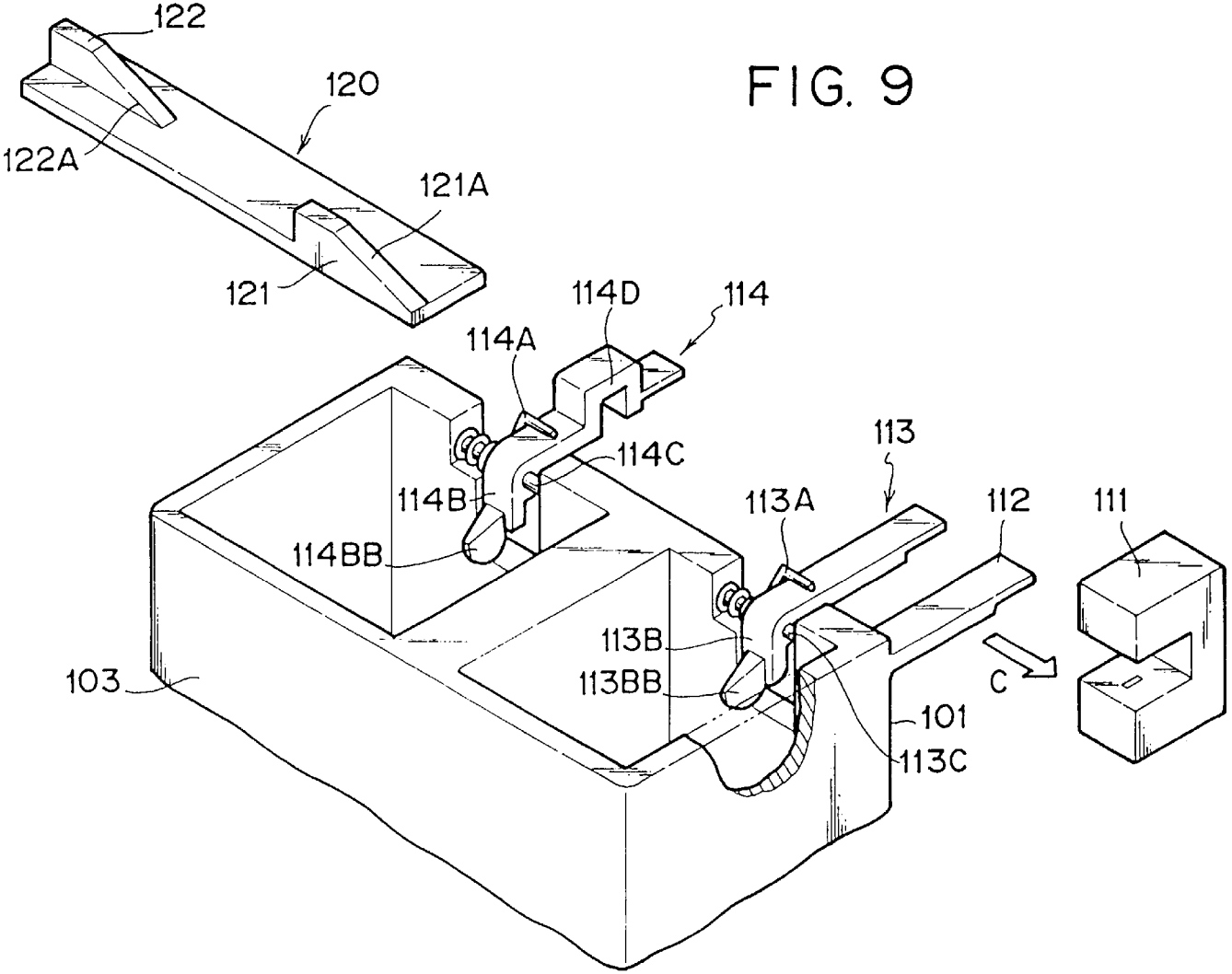
FIG. 9 is a perspective view schematically showing a state where the ink cartridge is installed according to the embodiment shown in FIG. 6.

On the other hand, first grooves 104A (105A) and second grooves 104B (105B) are arranged in parallel in the ink cartridges 104 and 105 as shown in FIG. 7. When the ink cartridge 104 is inserted into the cartridge guide 103 from the inlet 103A for inserting ink cartridge in the direction indicated by an arrow A, for example, the actuation arm 113B of the movable interrupter 113 is fittingly inserted into the first groove 104A (see FIG. 8). Then the extrusion 113BB of the actuation arm 113B slides along the tapered portion 104AA of the first groove 104A to cause the movable interrupter 113 to stand up in the direction of the sensor 111 as shown in FIG. 9, and at the same time, actuate the member 113 in the directions each indicated by an arrow B in FIG. 7 and FIG. 8 against the force of the spring 113A. The function of the second groove 104B will be referred to when the remaining operation is described. Here, the same action as described above will take place when the ink cartridge 105 is inserted.

Figure 10:
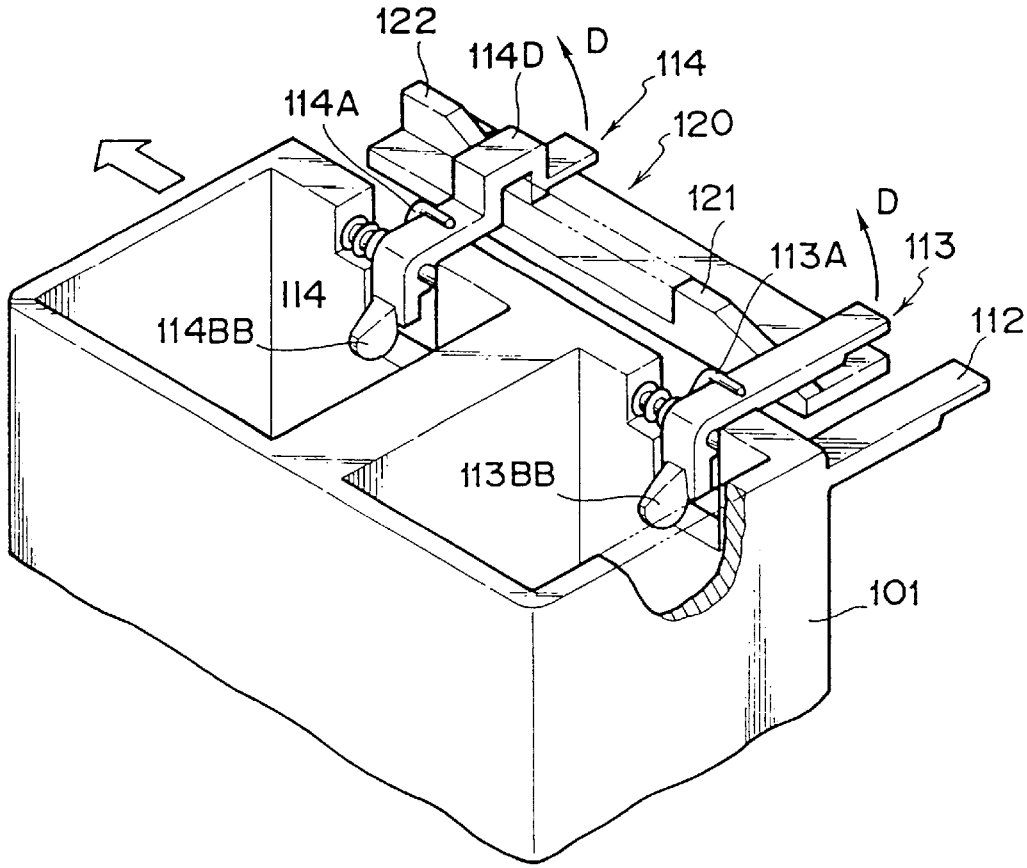
FIG. 10 is a perspective view schematically showing a state of engagement of the ink cartridges with a resetting member after the installation thereof according to the embodiment shown in FIG. 6.

Now, in conjunction with FIG. 9 and FIG. 10, the description will be continuously made of the operation of the carriage 101 while the cartridge guide 103, ink cartridges 104, and 105 are being mounted on it. In FIG. 9 and FIG. 10, a reference numeral 120 designates a member (hereinafter referred to as resetting member) which participates in confirming the completion of action each time the ink cartridge 104 and/or 105 is replaced by allowing the resetting member to engage with the movable interrupters 113 and 114 extruding from the cartridge guide 103. It is preferable to arrange the resetting member 120 in a position outside the recordable area on the side opposite to where the HP detection sensor is arranged as shown in FIG. 6. In this respect, in order to make it easier to understand the structural setup, the mounted ink cartridges 104 and 105 are omitted in FIG. 9 and FIG. 10.

In FIG. 9 and FIG. 10, a reference numeral 114D designates a tunneled portion arranged on the extrusion of the movable interrupter 114, and also, 121 and 122, coupling ribs extruding upward from the resetting member 120 and having the tapered portions 121A and 122A formed on the recordable area side, respectively. These coupling ribs 121 and 122 are formed at the same interval as the distance between the movable interrupters 113 and 114.

Now, after the ink cartridge 104 or 105 is replaced (see FIG. 6) and further, the resetting and recovery operation are carried out in the home position, the cartridge guide 103 maintained in the state shown in FIG. 9, and the movable interrupters 113 and 114 extruding from the guide are conducted to the position of the resetting member 120 as shown in FIG. 10. Then by means of the coupling ribs 121 and 122 of the resetting member 120, the movable interrupters 113 and 114 are caused to rotate in the direction indicated by arrows D at this time. As a result, the extrusions 113BB and 114BB provided for the movable interrupters 113 and 114 disengage from the first grooves 104A and 105A shown in FIG. 7. Then the interrupters are guided to the second grooves 104B and 105B by the force of the springs 113A and 114A.

In this respect, as shown in FIG. 7, the tapered portions 104C and 105C care formed on the end side of the ink cartridges 104 and 105 in the direction in which to pull them up. Therefore, it is easy to withdraw the ink cartridges 104 and 105 in the direction indicated by an arrow A' at any place, respectively. At the same time that the ink cartridges are withdrawn, the movable interrupters 113 and 114 can be set in the state shown in FIG. 7 or FIG. 8. These operations are carried out for each of the ink cartridges 104 and 105. Also, the presence or absence of the ink cartridges 104 and 105 are detected by the home position sensor 111. Although its operation will be described later in detail, if the ink cartridges 104 and 105 are not mounted on the cartridge guide 103 as shown in FIG. 8, for example, the home position sensor 111 detects at first a fixed interrupter 112 when the carriage 101 moves in the direction indicated by an arrow C, and then, detects no movable interrupter 113 and/or 114 in a given position. It is thus determined that the ink cartridges are absent.

Also, if the ink cartridges 104 and 105 are mounted, the home position sensor 111 detects the fixed interrupter 112, the movable interrupters 113 and 114 one after another in that order as shown in FIG. 9, thus determining that the ink cartridges are present.

Figure 11A:
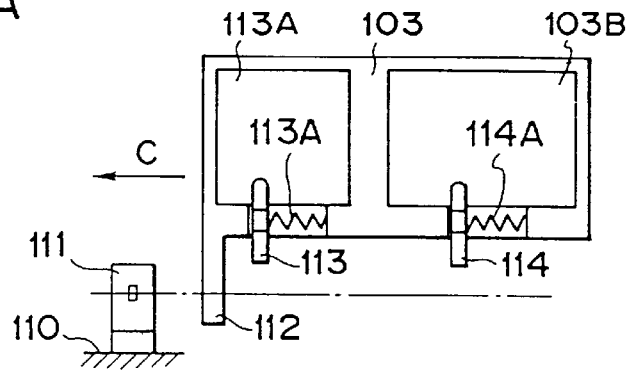
FIGS. 11A to 11D are views schematically illustrating the processes in which each of the detection stages is obtained after the replacement of ink cartridges according to the embodiment shown in FIG. 6.

Now, in conjunction with FIGS. 11A to 11D, the description will be made again in detail of the detecting operation to be executed as above for determining the presence or absence of the ink cartridges 104 and 105. In FIG. 11A, the ink cartridges 104 and 105 are yet to be mounted on the cartridge guide 103 as shown in FIG. 8. In this state, the carriage 101 moves in the direction indicated by an arrow C so that it is guided to the position of the HP (home position) detection sensor 111. Then only the fixed interrupter 112 which extrudes from the carriage 101 is detected by the HP detection sensor 111. The movable interrupters 113 and 114 are not detected because these interrupters do not extrude toward the HP detection sensor 111 side. Hence it is determined that there are no ink cartridges, and then, an error signal is output from a controller, for example.

Figure 11B:
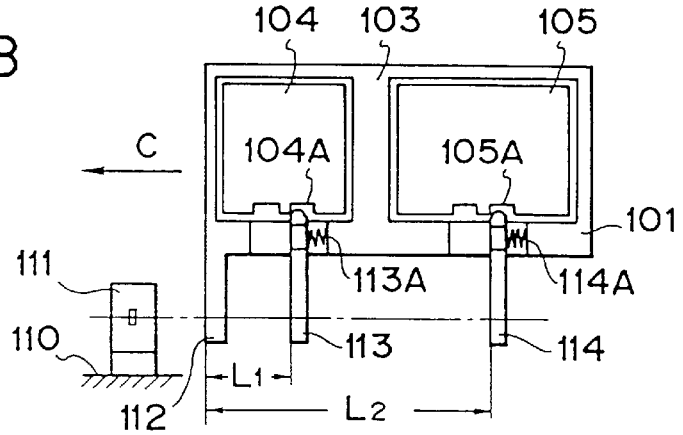

FIG. 11B illustrates the detecting operation immediately after the ink cartridges 104 and 105 are mounted. In this case, as described earlier, the extrusions 113BB and 114BB of the movable interrupters 113 and 114 are held by the first grooves 104A and 105A on the ink cartridges 104 and 105 side, respectively, and at the same time, the members 113 and 114 are held to extrude toward the HP detection 111 side as shown in FIG. 11B. Here, in this case, reference marks L1 and L2 designate the interval between the fixed interrupter 112 and the movable interrupters 113 and 114 in this state. In this way, immediately after the ink cartridges 104 and 105 are mounted, the HP detection sensor 111 detects the movable interrupters 113 and 114 passing at intervals L1 and L2 subsequent to having detected the fixed interrupter 112 as described above. Thus the installation of both ink cartridges 104 and 105 are detected. In this respect, if only either one of the ink cartridges is mounted, one of the movable interrupters is detected subsequent to the detection of the fixed interrupter 112 so that such a state is distinguished from the other, although not shown in the drawing.

Figure 11C:
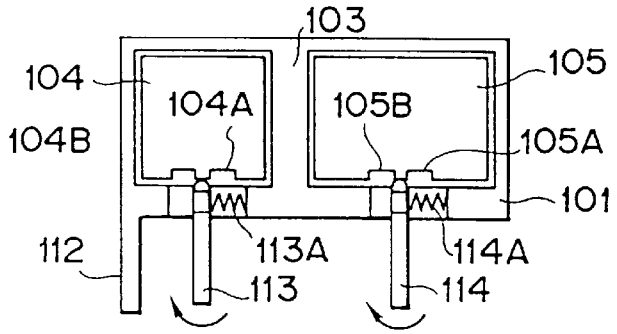
Figure 11D:
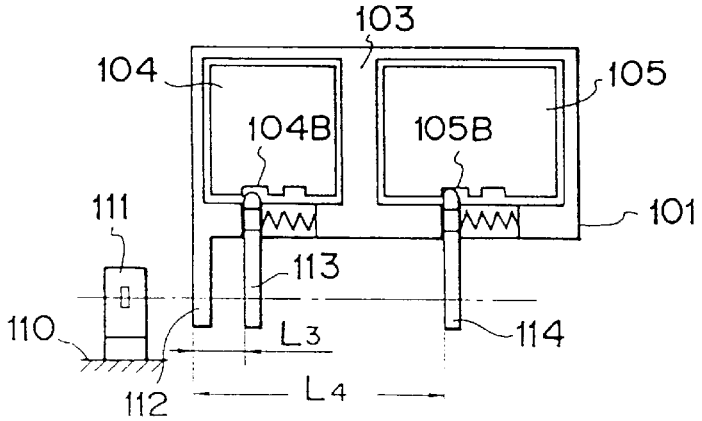

FIG. 11C illustrates the state in which the carriage 101 is conducted to the resetting position as described earlier regarding the state of installation of the ink cartridges 104 and 105 in conjunction with FIG. 10, and then, by means of the coupling ribs 121 and 122 of the resetting member 120, the movable interrupters 113 and 114 are caused to shift from the first grooves 104A and 105A of the ink cartridges 104 and 105 to the second grooves 104B and 105B. Also, FIG. 11D illustrates the state after such a shift. Here, the reference marks L3 and L4 designate the distance between the fixed interrupter 112 and the movable interrupters 113 and 114 after the position thereof is moved due to the engagement of the carriage 101 and cartridge guide 103 with the resetting member 120.

Figure 12:
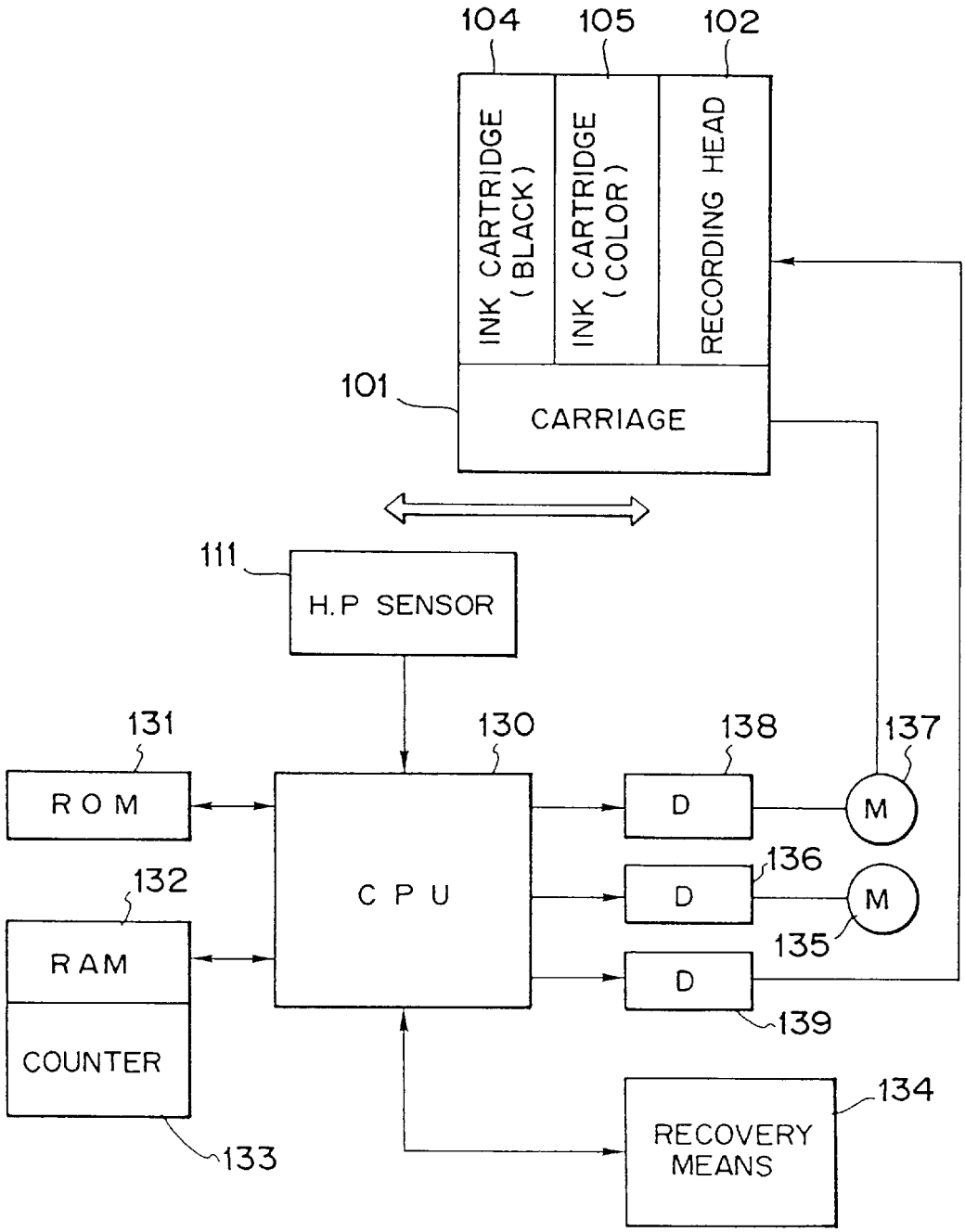
FIG. 12 is a block diagram showing the structure of a circuit according to the present invention.

FIG. 12 shows the structure of a circuit for controlling the embodiment represented in FIG. 6. In FIG. 12, reference numeral 130 designates a central processing unit (CPU); 131, a ROM; 132, a RAM; and 133, a counter. In the ROM 131, a program of procedure is stored for controlling the ink cartridge when it is reset as described later, in addition to various programs for recording operations. The counter 133 retains the counted number of discharges from the recording head 102 per kind of ink, and when the counted discharge numbers arrive at a predetermined value, a message or the like to prompt the replacement of the ink cartridge is indicated on a display means (not shown), for example. A reference numeral 134 designates recovery means for recovering the recording head 102; 135, a motor for feeding and supplying sheets; 136, a driver for this motor; 137, a motor for moving the carriage; 138, a driver for this motor; and 139, a driver for the recording head 102.

Figure 13:
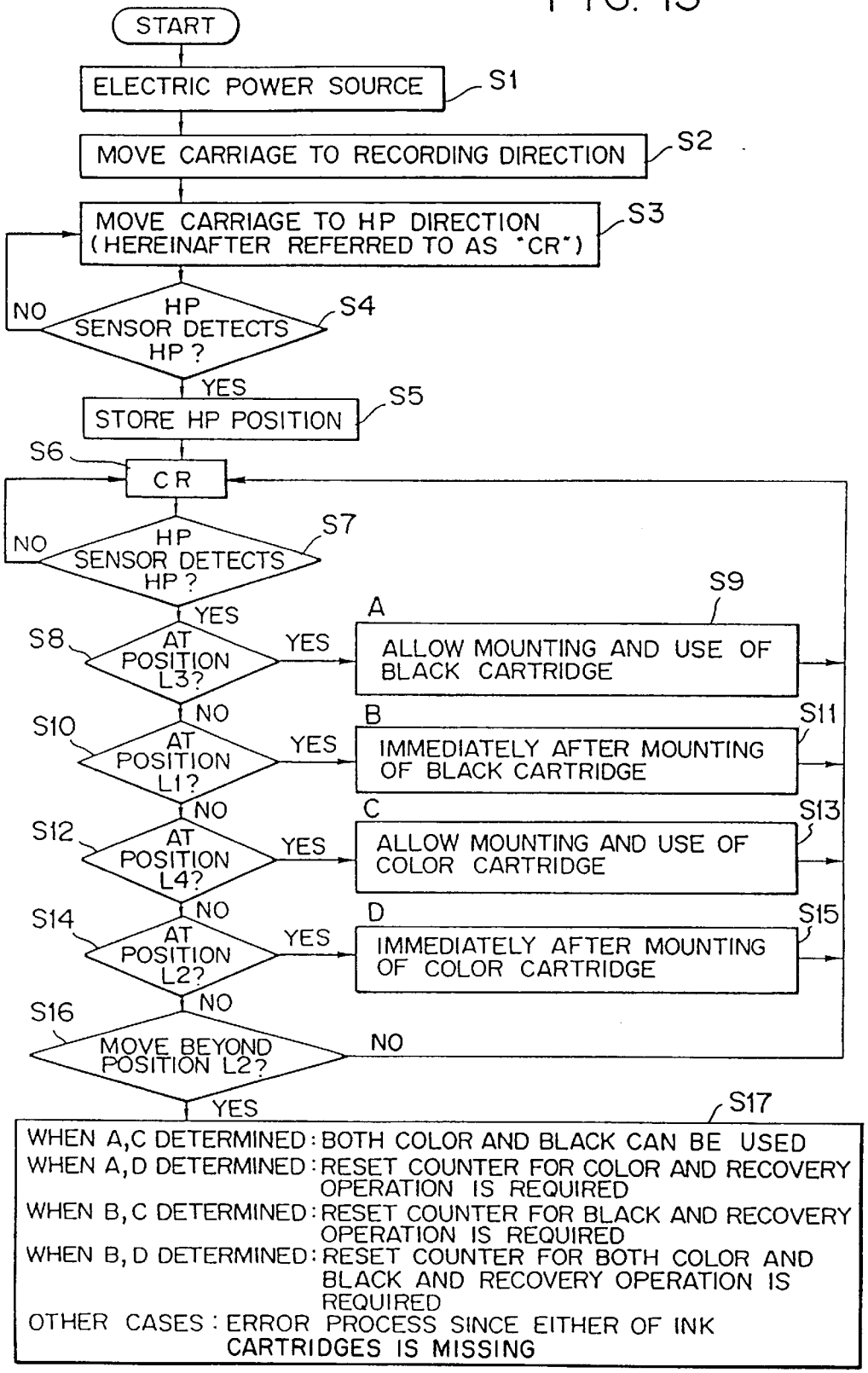
FIG. 13 is a flowchart showing the operational procedure for detecting ink cartridges according to the embodiment shown in FIG. 6.

Now, in conjunction with FIG. 13, the description will be made of the procedures of an operation for controlling the replacement of ink cartridges.

In step S1, when the power-supply is turned on, the carriage 101 is once moved in step S2 to the recording area side as shown in FIG. 6. Then, in step S3, it is moved to the HP side (hereinafter, the movement in this direction is referred to as CR). In step S4, when the fixed interrupter 112 arranged on the carriage 101 is detected by the HP detection sensor 111, the process will proceed to step S5 where the HP position of the carriage 101 is stored. Then, in step S6, the carriage is caused to further advance to the right-hand side in FIG. 6 (CR). In step S7, it is determined whether or not the movable interrupter 113 is detected by the HP detection sensor 111. If affirmative, it is further determined in step S8 whether the detected position is at the distance L3 or L1 from the aforesaid detection position of the fixed interrupter 111. If the distance is founded to be L3, it is determined in step S9 that the recovery operation has been already executed by the recovery means 134, and the counter 133 has been already reset in the HP after an ink cartridge for black ink is installed.

Also, in step S10, if the distance is-found to be L1, it is determined in step S11 that the status is immediately after the installation of the ink cartridge for black ink, and that the recovery operation and the counter resetting are yet to be carried out. On this determination, the recovery operation and the counter resetting are prompted. Thereafter, subsequent to the movement in the step S6, the detection by the HP detection sensor 111 is executed in steps S12 and S14 in that order in the same manner as above. Then, it is determined whether the position of the movable interrupter 114 is (L4) as shown in FIG. 11D or (L2) as shown in FIG. 11B. If the determination is affirmative in step S12, it is further determined in step S13 that the cartridge 105 for color ink is in a useable state. If the determination is affirmative in step S14, it is further determined in step S15 that the ink cartridge for color ink is in a status immediately after the installation (that is, the recovery operation and the counter resetting are yet to be executed).

In this way, in step S16, it is determined that the cartridge 101 is moved to a position outside the HP detection sensor 111 together with the cartridge guide 103 as shown in FIG. 6. Then the process will proceed to step S17 so that the operation is executed by the routine corresponding to the determination made by the combination of the determined states in steps S9, S11, S13, and S15. In other words, given the states in the steps S9, S11, S13, and S15 as A, B, C, and D, respectively, both color and black can be used if the combination is A and C. Therefore, a recording by use of these kinds of ink become permissible. Also, if the combination is A and D, only for the color ink, the recovery operation and counter resetting should be executed before recording. If the combination is B and C, only for the black ink, the recovery operation and counter resetting should be executed. Further, if the combination is B and D, both for the black ink and the color ink, the recovery operation and counter resetting should be executed before recording.

In this respect, if the determinations are all negative in steps S8, S10, S12, and S14, the ink cartridges 104 and 105 are not installed at all. Also, if the determinations are negative only in the steps S8 and S10, only the ink cartridge for the black ink is not installed. If the determinations are negative only in the steps S12 and S14, it is determined that the ink cartridge for the color ink is yet to be installed. Thus the process is treated as an error, for example.

Figure 14A:
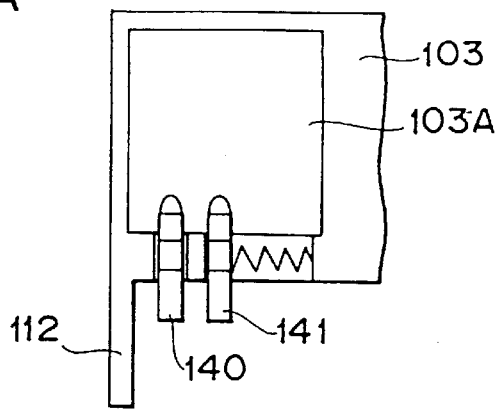
FIGS. 14A to 14C are views schematically illustrating the structure around a cartridge guide according to still another embodiment of the present invention as well as the operation of installing the ink cartridge.
Figure 14B:
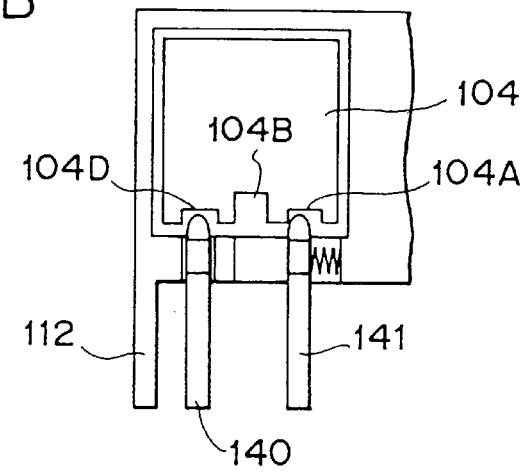
Figure 14C:
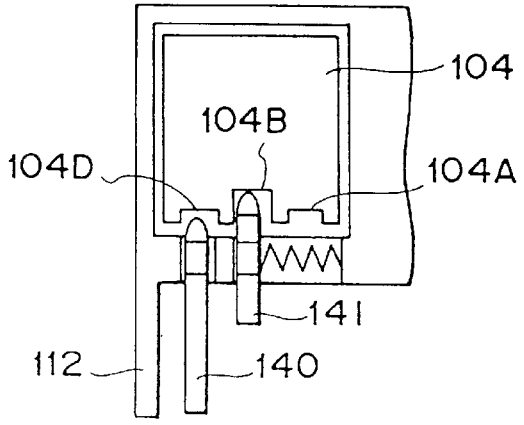

FIGS. 14A to 14C are views showing another embodiment according to the present invention. However, since the fundamental structure of the cartridge guide 103 is the same, the description will be made of only the attachment and detachment operation as well as the structure of the detection means for cartridge regarding the cartridge 104 for the black ink. The description of those regarding the color ink side will be omitted.

For the carriage 101, there are arranged a fixed interrupter 112, and two movable interrupters for the respective insertion inlets 103A and 103B, that is, an interrupter 140 for detecting the presence and absence of the cartridge, and an interrupter 141 for detecting the reset condition. The interrupter 140 for detecting the presence and absence of the cartridge, which is interlocked with the groove 104D, is caused to extrude or retract by interlocking with the attachment or the detachment of the cartridge 104 (105), while the interrupter 141 for detecting the resetting condition slides into the second groove 104B (105B) of the cartridge after the completion of the recovery operation is detected in the home position by the resetting member, for example, as in the embodiment described in conjunction with FIGS. 6 to 13. However, since the groove 104B (105B) is deep, the interrupter 141 cannot extrude to the home position side, but retracts. Thus, if the cartridge is yet to be installed as shown in FIG. 14A, only the fixed interrupter 112 is detected by the HP detection sensor. Therefore, immediately after the installation of the cartridge, two movable interrupters 140 and 141 are added, and three interrupters are detected as shown in FIG. 14B. Also, as shown in FIG. 14C, after the resetting and recovery operation, the movable interrupter 141 retracts. Therefore, the remaining two interrupters are detected. According to the present embodiment, the above-mentioned three states are determined by the number of interrupters. Consequently, compared to the detection to be carried out depending on the current distances between the interrupters, the tolerance can be greater for the precision in which the parts should be finished. Particularly when a plurality of objective cartridges are present, it will suffice if only the numbers of interrupters are counted for detection subsequent to the detection of the fixed interrupter 112.

Figure 15:
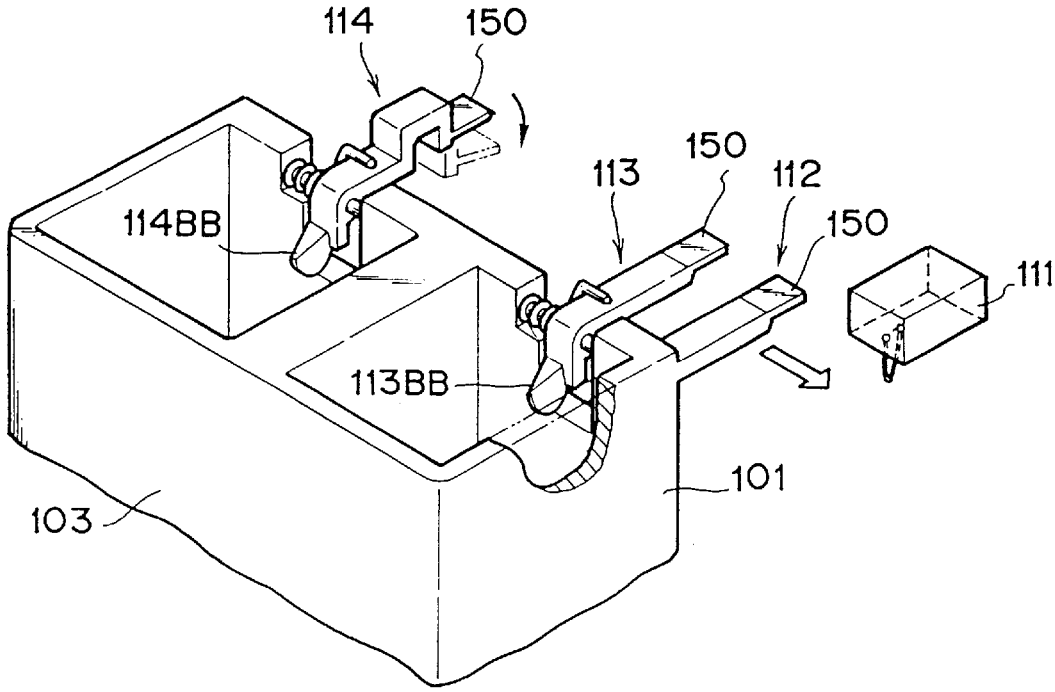
FIG. 15 is a view schematically showing the structure around an ink cartridge according to still another embodiment of the present invention.

FIG. 15 illustrates an example in which the HP detection sensor 111 is formed by a reflection type photosensor. The portions of the interrupters 112, 113, and 114, which participate in detection together with the sensor, are made of a reflective plate 150, respectively. In this case, if the escape angle of the reflective plate 150 are assumed to be small as indicated by the broken line, it does not reflect. As a result, it is unnecessary to retract the interrupter almost at 90° for the purpose as in the case of the previous embodiments. Particularly, in a case where the number of the interrupters detected by the sensor is arranged to be changed as in the embodiment in FIGS. 14A to 14C, the depth of each of the grooves 104A, 104B, and 104C for the cartridge can be made shallower.

Figure 16:
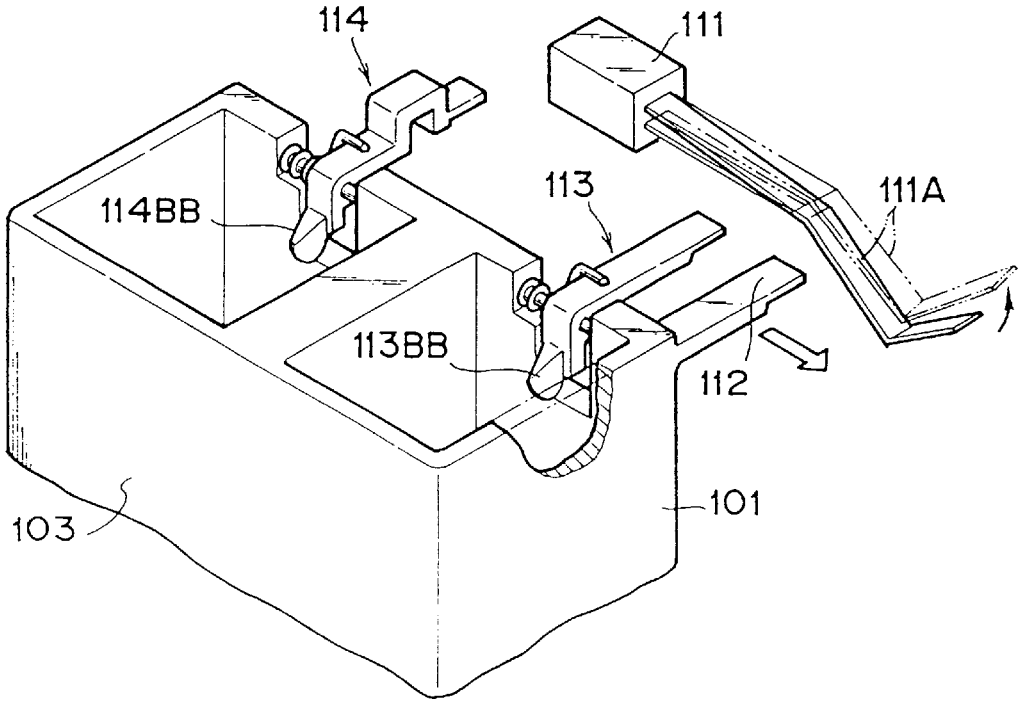
FIG. 16 is a view schematically showing the structure around an ink cartridge according to still another embodiment of the present invention.

FIG. 16 illustrates an example in which the contact of a flat spring 111A is utilized for the HP detection sensor 111 to function. With this, the fabrication cost can be reduced.

Figure 17:
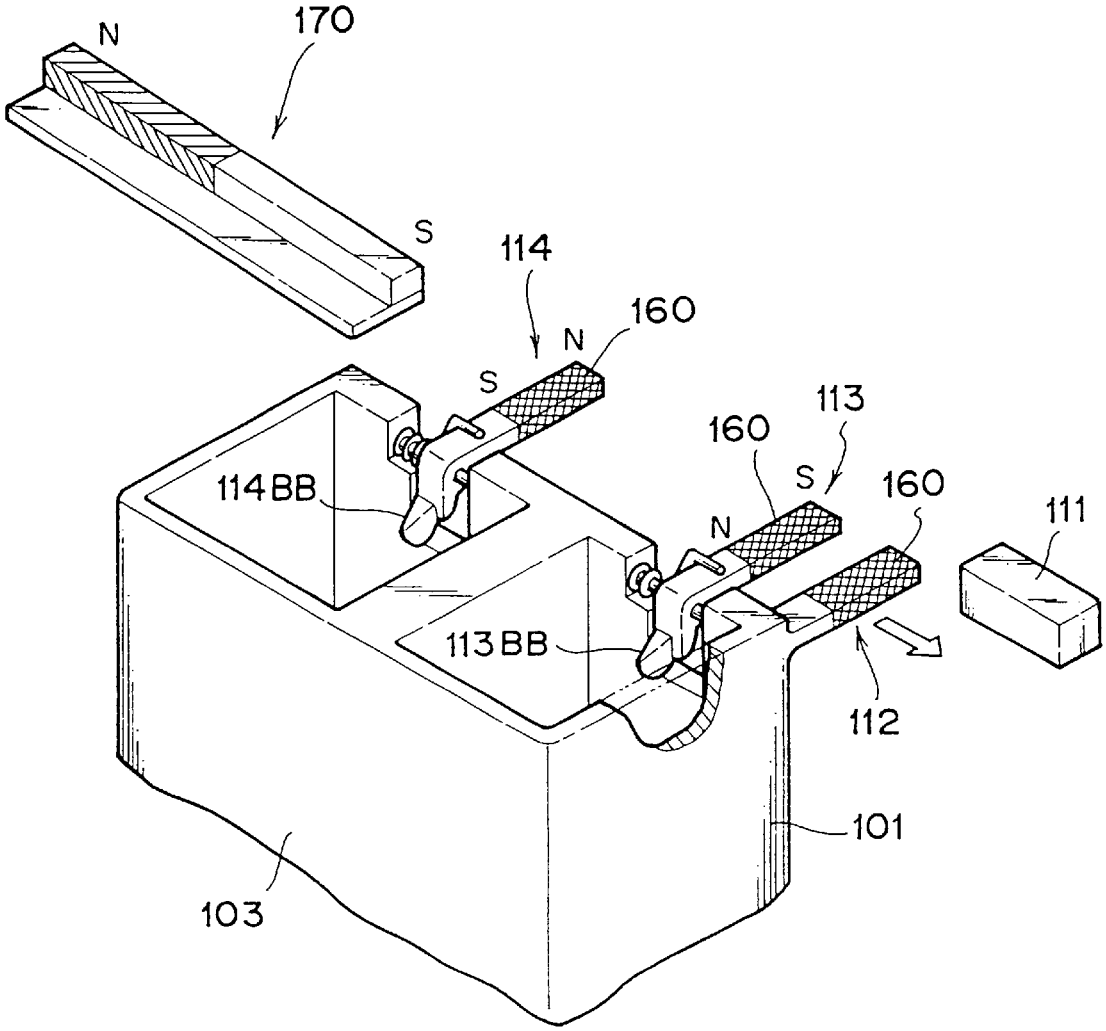
FIG. 17 is a view schematically showing the structure around an ink cartridge according to still another embodiment of the present invention.

Also, FIG. 17 illustrates an example in which the HP detection sensor is arranged to be of a lead switch type. The portions of the interrupters 112, 113, and 114, which participate in detection together with the sensor, are formed by a magnet 160, respectively. In this case, instead of the coupling ribs, a magnet is used as a resetting member 170, as shown in FIG. 17. This magnet has the poles opposite to those of the magnets provided for the movable interrupters 113 and 114.

As described above in detail, according to the embodiments represented in FIG. 6 to FIG. 17, there are provided the means for detecting positions, which is arranged with respect to the home position, and detects the shifted positions of the carriage; and a fixed piece arranged for the carriage along the direction in which the carriage moves for detection by the aforesaid means for detecting positions; and the movable pieces which are interlocked with each operation of the ink cartridge installations to the carriage, and whose positions are changeable between the position in which the pieces can be detected by the aforesaid means for detecting positions, and the position in which the pieces cannot be detected thereby. With the aforesaid fixed piece to be detected, the movement of the carriage to its home position can be detected. Also, with the movable pieces to be detected, the presence and absence of the installed ink cartridges on the carriage can be detected. Consequently, with a small and simple structure, it is possible to detect the presence and absence of the installed ink cartridges, the resetting of the counted value of ink discharge numbers after the installation, and the execution of the required recovery operation by the application of means for detecting positions and the detected positions of the movable pieces provided for the carriage. In this way, an ink jet recording apparatus which is easy to operate can be provided at a low cost. This apparatus does not force its operator to do any extra work on operating keys or the like after replacement of ink cartridges.

Also, the detection means described above in conjunction with FIG. 6 to FIG. 17 not only can detect the attachment and detachment of the ink cartridges to the carriage, but also can detect the attachment and detachment of a head to the carriage for reading out a recording head and an original document.

Also, according to the above-mentioned embodiments, printed images of an excellent quality can be obtained, of course, by use of an ink jet recording head which will be shown later in FIG. 20.

Now, in conjunction with FIG. 18 to FIG. 26, the description will be made of another embodiment according to the present invention.

Figure 18:
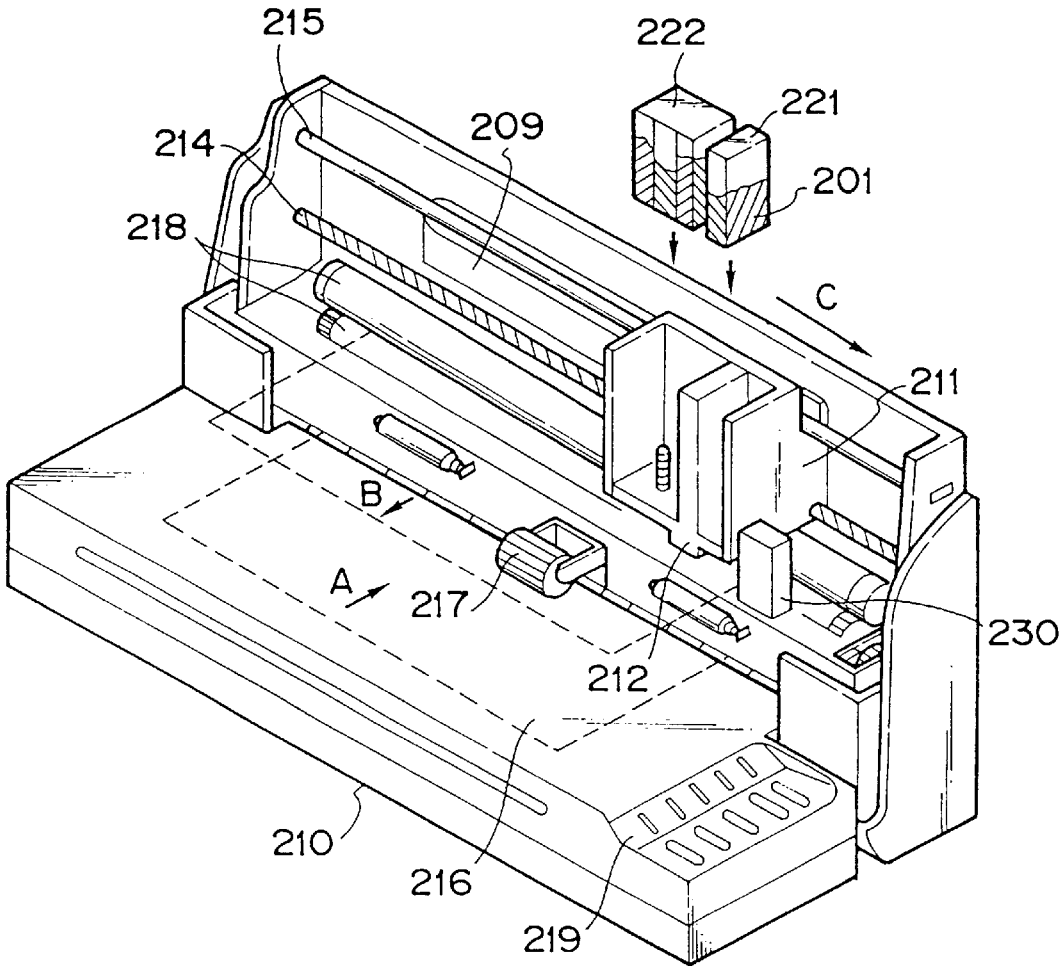
FIG. 18 is a perspective view schematically showing another embodiment of an ink jet recording apparatus according to the present invention.

As shown in FIG. 18, when a recording apparatus 210 is in a recording operation, a recording medium 216 is fed by a feed roller 217 in the direction indicated by an arrow A. Further, it is exhausted by an exhaust roller 218 in the direction indicated by an arrow B. This movement is the subscan. During this period, the recording head 212 mounted detachably on a carriage 211 reciprocates along a guide shaft 215 by the movement of a lead screw 214 rotated by a motor for driving the carriage. This movement is the main scan. When the main scan is in operation, the subscan is at rest. During the period of a main scan, the ink droplets are discharged from the discharge ports of the recording head 212 as required in response to the inputted data. A flexible cable 219 is for inputting the aforesaid data and control signals to the recording head 212. An ink tank 221 for black ink and an ink tank 222 for color ink are for retaining each of the color ink to be supplied to the recording head 212. Each of the ink tanks 221 and 222 is also detachably mountable on the carriage 211.

As described above, the recording head 212 is structured to be detachably mounted on the carriage 211. Should any trouble take place in the recording head 212, it is possible to replace such a recording head 212 with a regular product. Also, each of the ink tanks 221 and 222 are structured to be exchangeable. When ink is totally consumed after a given amount of recording operation, it can be replaced with a new ink tank.

Figure 19:
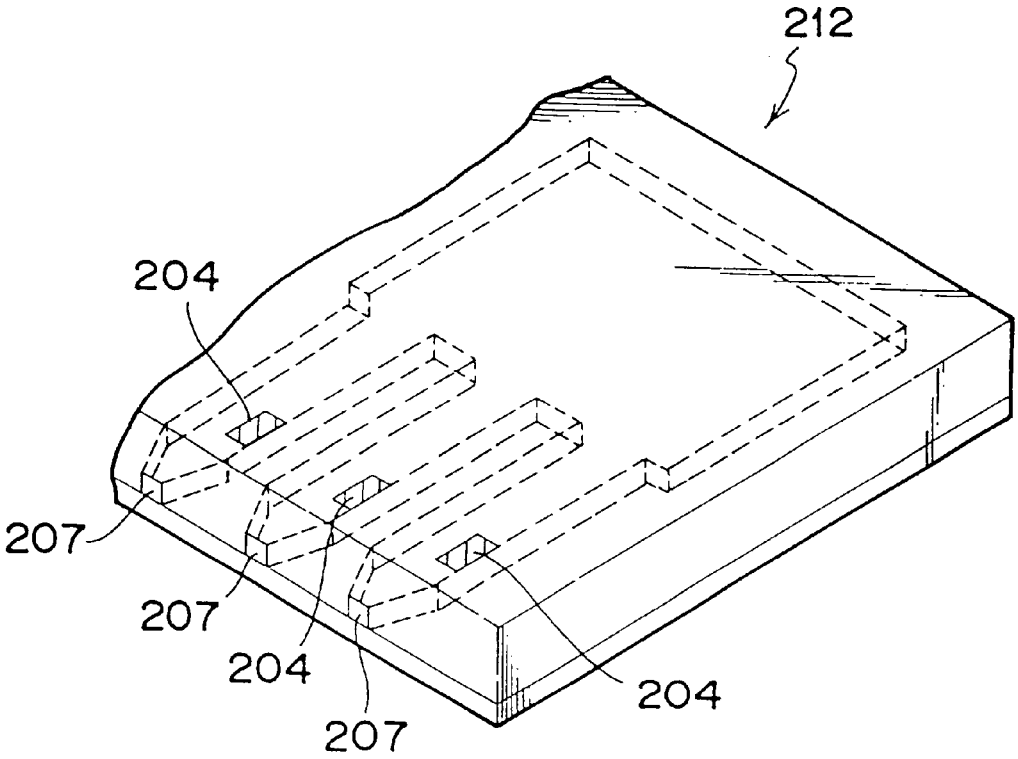
FIG. 19 is a perspective view schematically showing the ink jet recording head represented in FIG. 18.

As shown in FIG. 19, there is arranged for each of liquid passages in the ink jet recording head 212, the electrothermal transducer 204 to which an applied voltage is supplied for generating the thermal energy in order to discharge recording liquid from each of the plural discharge ports 207 which are arranged in an array. When a driving signal is applied, each of the respective electrothermal transducers 204 generates thermal energy to create film boiling in the ink liquid passage for the formation of air bubble in it, and then, by the development of this air bubble, an ink droplet is discharged from each of the discharge ports 207.

Figure 20:
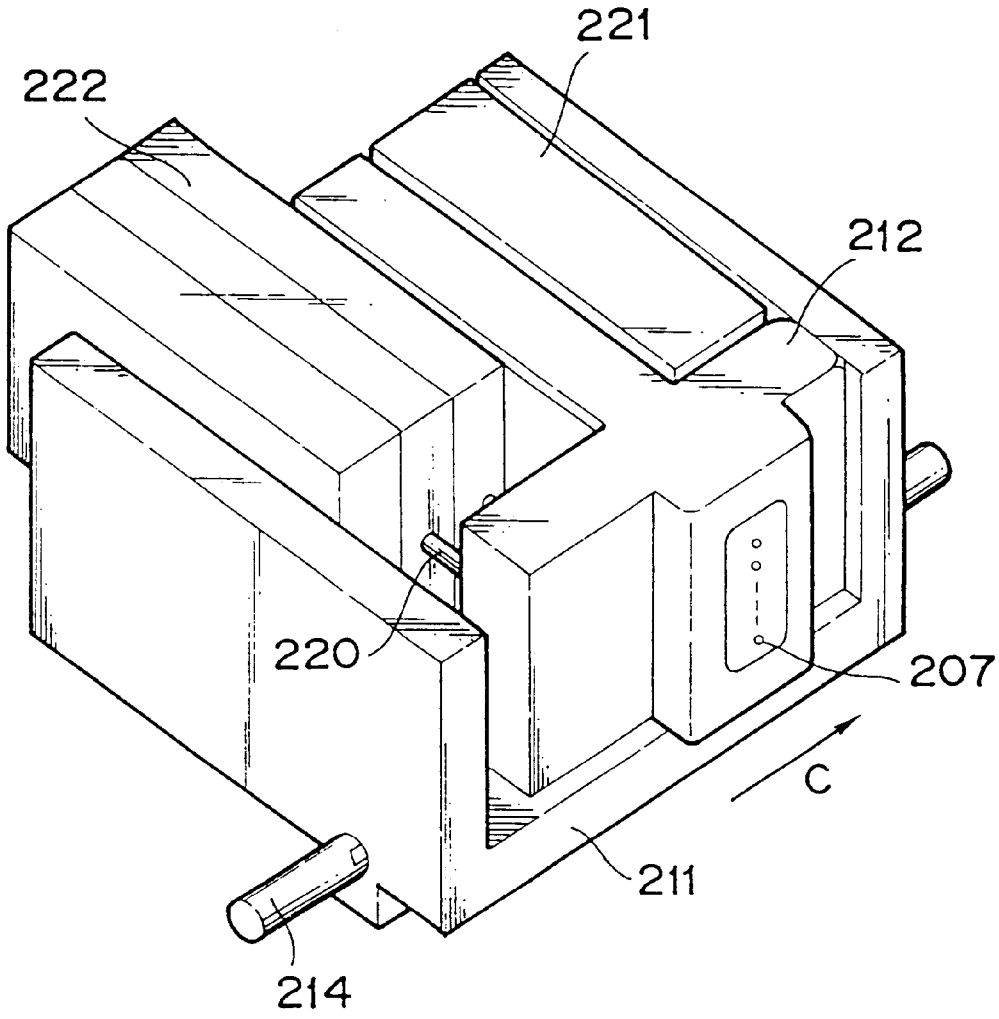
FIG. 20 is an exploded perspective view schematically showing an ink Jet recording head and a carriage.

FIG. 20 is an exploded perspective view showing the recording head and the carriage. The recording head 212 is mounted on the carriage 211. Further, the ink tank 221 for black ink and the ink tank 222 for color ink are connected to the recording head 202 through each individual connecting pipe 220. The interior of the ink tank 222 for color ink is partitioned for yellow, magenta, and cyan separately. The number of the discharge ports 207 for discharging ink is 136 in total. In FIG. 20, there are arranged from the above, 24 ports for yellow, 24 ports for magenta, and 24 for cyan, and 64 for black in that order.

Figures 21A, 21B:
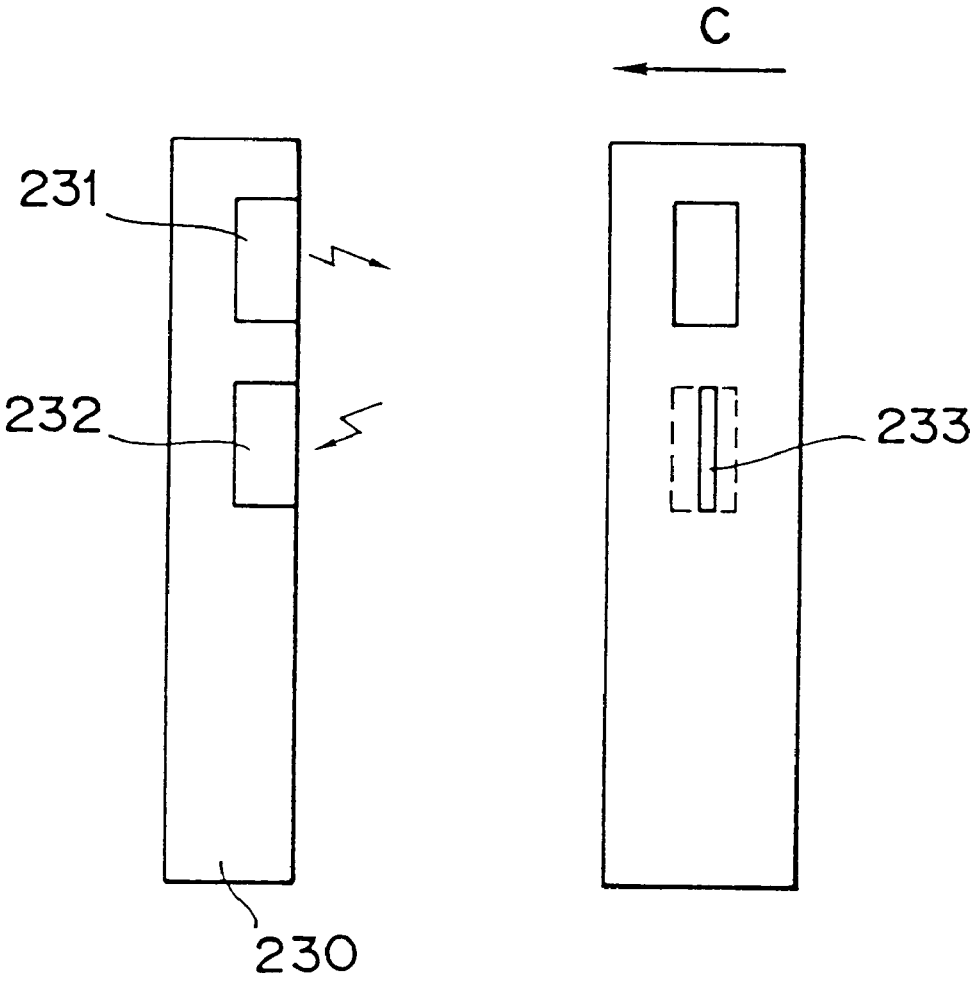
FIG. 21A is a side view schematically showing an optical sensor.
FIG. 21B is a front view schematically showing the optical sensor.

Now, the features of the present embodiment will be described. FIG. 21A is a side view showing a sensor. FIG. 21B is a front view showing it.

As shown in FIG. 18 to FIG. 21B, the sensor 230 is fixed to the main body of the recording apparatus so that it can be positioned within the movable range of the carriage 211 of the recording apparatus 210. This sensor 230 is an optical sensor. A beam is emitted from the light emitting portion 231 thereof, and the sensing is effectuated by receiving the beam reflected from an object by use of the photodetecting portion 232. A slit 233 is arranged in front of the photodetecting portion 232 in order to make the detecting orientation of the reflected beam better, thereby to enhance the precision of detection. The electric circuit for the sensor 230 is structured so that a high (H) level signal is output to a controller which will be described later when there is an object immediately before the sensor 230, and a low (L) level signal is output thereto if there is no object. If the object has a good absorption of light, there is a possibility that the low (L) level signal is output even if an object is present. Therefore, it is desirable to use a material having a particular characteristic of light reflection for an object to be sensed, that is, the surfaces of the carriage 211, the recording head 212, and each of the ink tanks 221 and 222.

Figure 22:
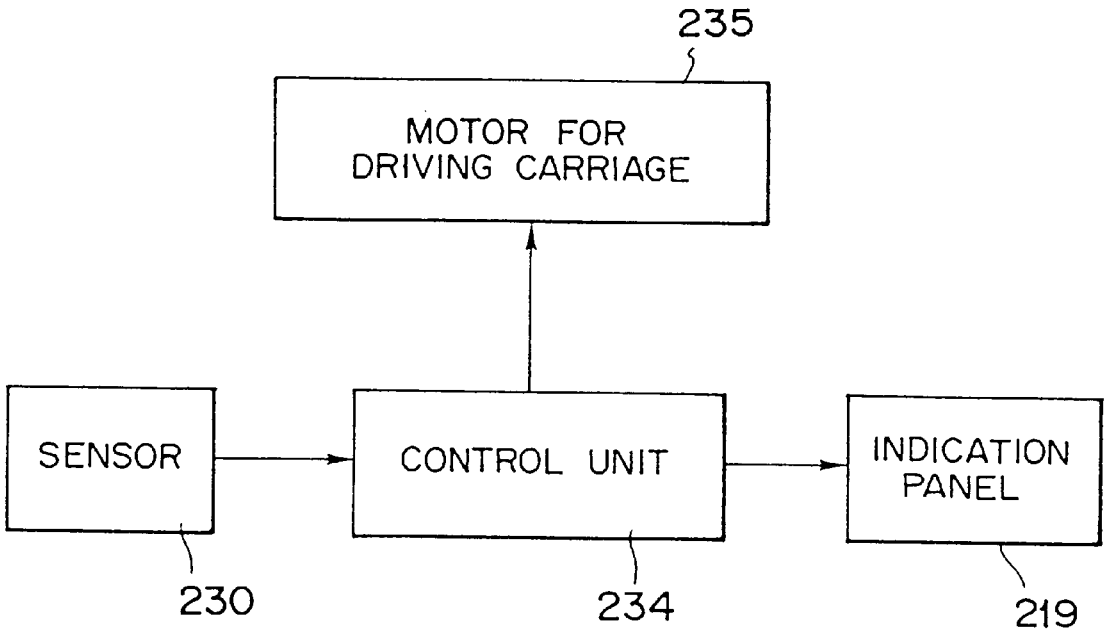
FIG. 22 is a block diagram showing a control system for a sensor and a controller.

As shown in FIG. 22, the sensor 230 is connected to the controller 234 of the recording apparatus 210 (see FIG. 18), and on the indication panel 219, whether the sensor 230 outputs a low (L) level signal or a high (H) level signal is displayed.

Figure 23A:
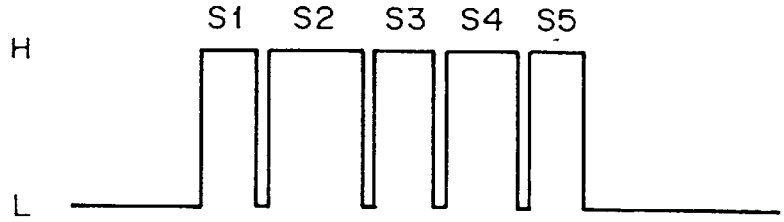
FIG. 23A illustrates a detection signal at the time of normal operation.
Figure 23B:
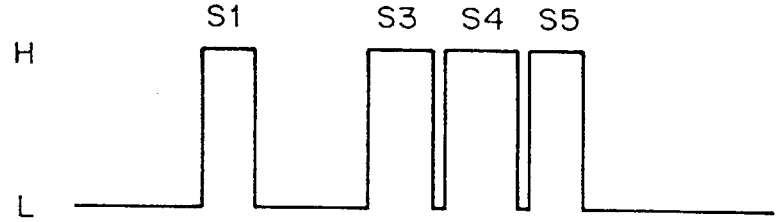
FIG. 23B illustrates a detection signal at the time of abnormal operation.

FIGS. 23A and 23B illustrate the signal detected by the sensor 230. FIG. 23A represents a signal at the time of regular operation. FIG. 23B represents a signal detected when no ink tank for color ink is installed. The normal operation of the carriage 211, the normal installation of the recording head, and the normal installation of each of the ink tanks are confirmed in the manner given below.

As shown in FIG. 17 to FIG. 23B, while monitoring signals from the sensor 230 immediately before a recording operation, the controller 234 controls the motor 235 for driving the carriage in order to allow the carriage 211 to scan at a speed slower than the traveling speed of the carriage in the usual recording operation. To slow down the scanning speed is to minimize any malfunction that may occur in detection. In synchronism with the traveling of the carriage 211, the signals from the sensor 230 are sensed. In a position where the end of the carriage 211 is supposed to be in a position immediately before the sensor 230, the signal S1 is sensed to examine whether or not the carriage 211 is in a normal operation. If no sense signal S1 is obtained at this juncture (that is, if it is an L level signal), the carriage operation is erroneous. Thus the controller 234 displays the carriage operation error on the indication panel 219. In the same way, the signal S2 from the sensor 230 in a position immediately before the ink tank 222 for color ink is sensed. If the signal is obtained, the operation is normal, but if no signal is obtained, it is determined that there is no installation of the ink tank 222 for color ink. Thus the controller 234 displays the color ink tank error on the indication panel 219. The same is applicable to the examination on the ink tank 221 for black ink. If an error indication is displayed, the recording operation is suspended.

In the embodiment described in conjunction with FIG. 18 to FIG. 23B, an example is represented, in which both the recording head and the ink tanks are exchangeable. However, the above-mentioned is not limited to such an example. It is also applicable to a case where only the ink tanks are exchangeable or to a case where only the recording head is exchangeable.

Also, in the above-mentioned embodiment, the description has been made of the case where these are two ink tanks. However, it is not limited to such a case only. The number of ink tanks may be only one for the use of black ink or three for the use of yellow, magenta, and cyan, respectively, or four for the use of yellow, magenta, cyan, and black, respectively.

Figure 24A:
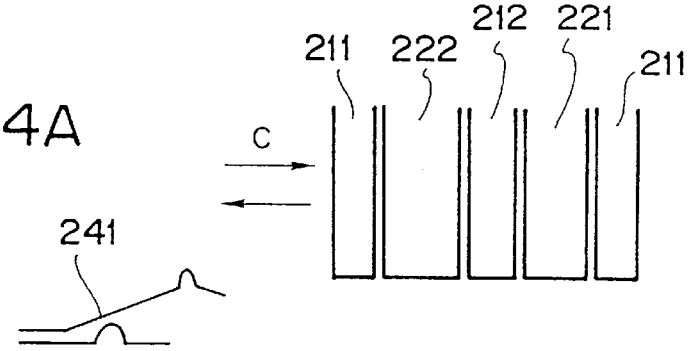
FIG. 24A illustrates a case in which a mechanical switch is used as a sensor.
Figure 24B:
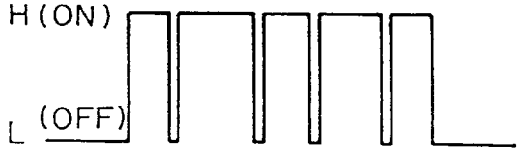
FIG. 24B illustrates a detection signal at the time of normal operation.

Further, an optical sensor is exemplified for use, but the sensor is not limited to the optical one. It may be possible to use a mechanical sensor, for example. FIG. 24A illustrates an example of a mechanical sensor. The carriage 211, each of the ink tanks 221 and 222, and the recording head 211 move correlatively to the main body of the recording apparatus in the direction indicated by an arrow C to abut on a mechanical switch 241. Then the mechanical switch 241 can obtain a signal shown in FIG. 24B. FIG. 24B illustrates the signal generated in a normal case.

In this respect, it may also be possible to use a magnetic sensor for detection by forming an object to be sensed with a metal or a magnetic material.

Figure 25:
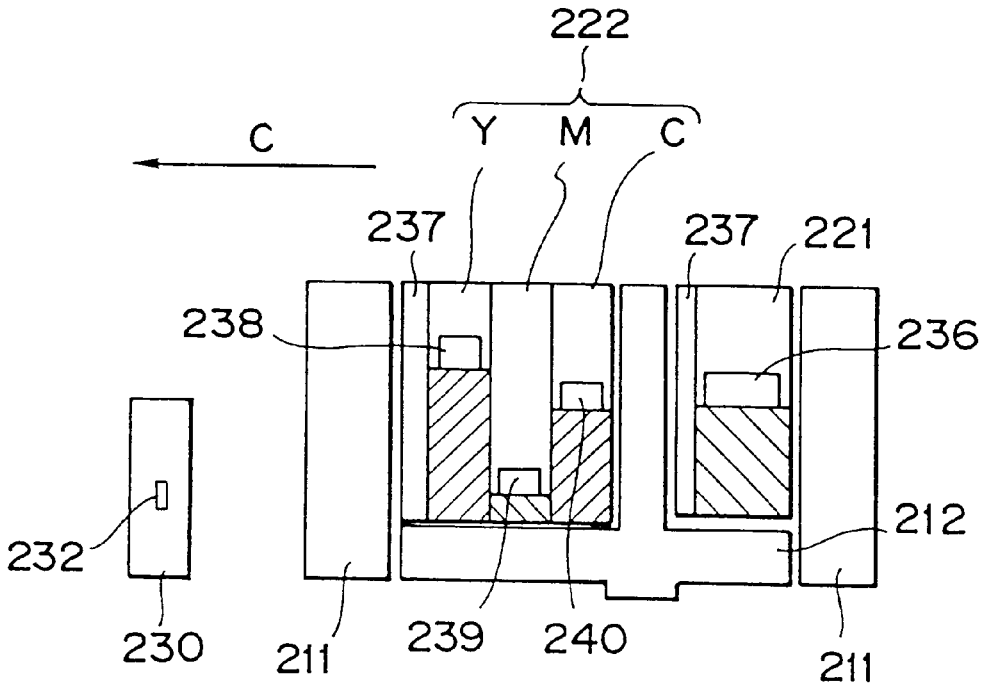
FIG. 25 is a view schematically showing the positional relationship between a recording head dually functioning to detect the ink remains, and a sensor.

In addition to the above-mentioned embodiments, the ink remains for each color ink can be detected. FIG. 25 is a view showing a structure in which the detection of the ink remains is dually provided. This view represents the positional relationship between a recording head and a sensor, which are observed from behind. The photodetecting portion 232 of the sensor 230 is positioned in a location corresponding to the lower part of the ink tanks 221 and 222. In FIG. 25, the remains in the magenta ink tank (M) is small in the tank 222 for color ink. This results in an error for no magenta ink. The left end side of each of the ink tanks 221 and 222 is arranged to a reflective portion 237 which senses the presence or absence of the ink tank. The ink tank is made of a material having a good transparency of light so that the ink contained in it can be sensed directly. If the ink also has a good transparency of light, floats 236, 238, 239, and 240 are provided in each of the ink tanks 221 and 222. If the position of any one of the floats 236, 238, 239, and 240 is detected at a lower part in the ink tank, it is assumed that the ink remains in that particular tank are small or zero. Also, it is possible to detect the amount of ink in each of the ink tanks by arranging many numbers of photodetecting portions 232 of the sensor 230 over the depth direction of each ink tank.

Now, in conjunction with FIG. 26, another embodiment will be described.

Figure 26:
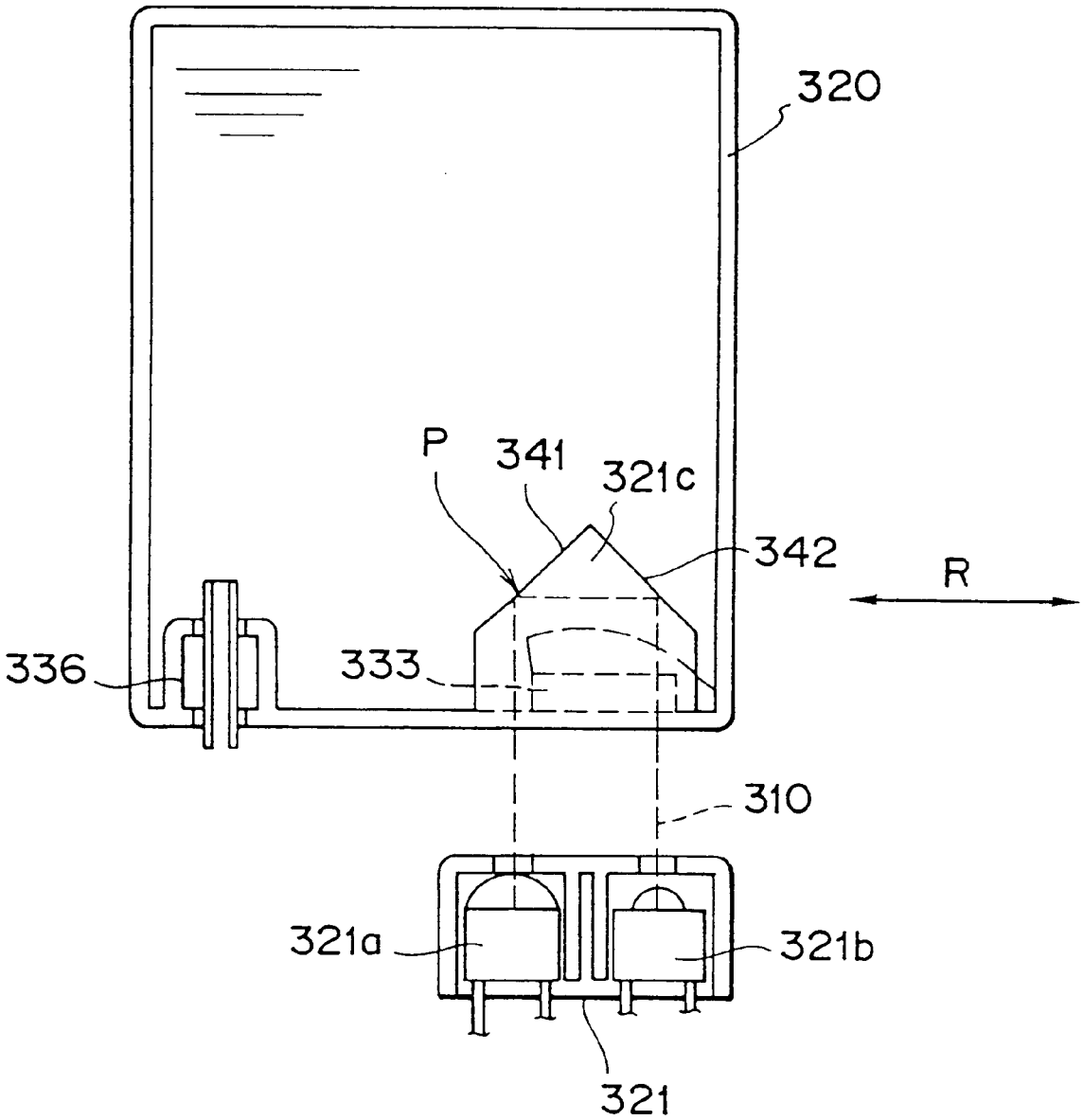
FIG. 26 is a view schematically illustrating another embodiment of a recording head having a structure which dually functions to detect the ink remains.

FIG. 26 is a cross-sectional view showing an ink cartridge 320. The present embodiment shown in FIG. 26 does not need any float 236, and shows a different structure for detection.

A detection sensor 321 for ink remains comprises a light emitting element 321*a* which emits infrared light 310 and a photodetecting element 321*b* capable of receiving light from the light emitting element 321*a*.

A light reflection prism 321*c* is formed integrally with the ink cartridge 320 by polypropylene or some other almost transparent material. Thus, when there is no ink on the inclined surfaces of the head portion of the light reflection prism 321*c*, the beam from the light emitting element 321*a* is reflected and caused to arrive at the photodetecting element 321*b*. On the other hand, when the ink is filled around the inclined surfaces of the head of the light reflection prism 321*c*, the reflection of the beam from the light emitting element 321*a* is reduced. The luminous energy which can arrive at the photodetecting element 321*b* becomes small to make it possible to detect the presence or absence of ink.

In this respect, a reference numeral 336 designates an ink supply outlet for supplying ink from the ink cartridge 320 to an ink jet recording head (not shown).

Hereinafter, the principle of the detection will be described.

The light reflection prism 321*c* has an angled part formed by inclined portions 341 and 342 almost at 90°.

This angled part is arranged in the ink cartridge 320 in such a manner that the infrared light emitted from the light emitting element 321*a* is reflected by the inclined portion 341, and then, reflected again by the inclined portion 342 to return it to the photodetecting element 321*b*.

Also, at least the part of the inclined- portions 341 and 342 where the remains are detected (the position P in FIG. 26, for example) is formed by a material having a light transparency of the same refractive index as or an index extremely close to that of the liquid which is contained in the cartridge or either one side of the inclined portions 341 and 342 is treated by a mirror processing or the like so that the infrared light can be reflected.

The specific principle of detection of the remains will be described as follows:

The refractive index of the air is approximately 1.0; that of ink, approximately 1.4; and that of polypropylene, approximately 1.5. This is an exemplified material for the formation of the part of the inclined portion 341 or 342 of the light reflection prism 321*c* where the remains are detected.

Here, (1) when ink is present in the ink cartridge 320, the reflective index of ink and that of the material of the part in the detecting position of the remains are extremely close to each other. Thus the infrared light 310 does not reflect on the inclined portion, and (2) if no ink is present in the ink cartridge 320, the reflective index of the air and that of the material of the part in the detecting position of remains are different. Thus the infrared light 310 reflects on the inclined portion. Then, the difference in the luminous energies arriving at the photodetecting element 321*b* at that time is transformed into electric signals by the known method of photoelectric transformation. In this way, it is possible to detect the presence or absence of ink in the ink cartridge 320.

Figure 27:
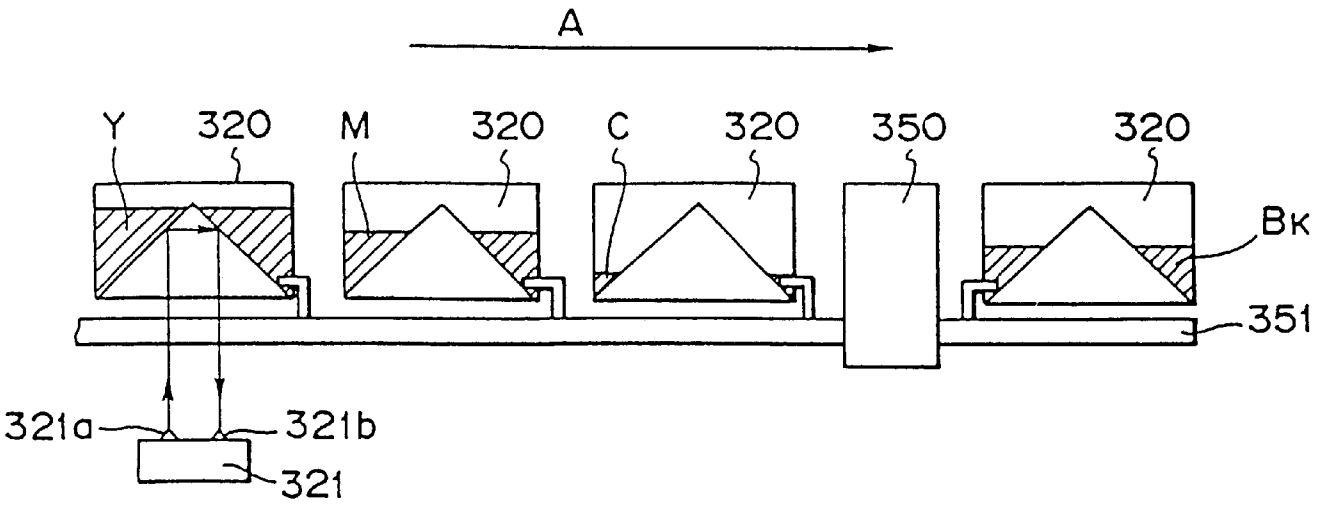
FIG. 27 is a view schematically illustrating a structural example of detecting a specific position of liquid level in an ink cartridge.

Here, as shown in FIG. 27, a plurality of ink cartridges are mounted on the carriage 351 movably together with the recording head 350. At the same time, each angled part formed by the inclined portions 341 and 342 is positioned upward in the ink cartridge, respectively. The inclined portions are formed by a material whose reflective index is extremely close to that of ink as described above. In this way, it is possible to detect the specific position of the liquid level of ink in each of the ink cartridges.

Figure 28:
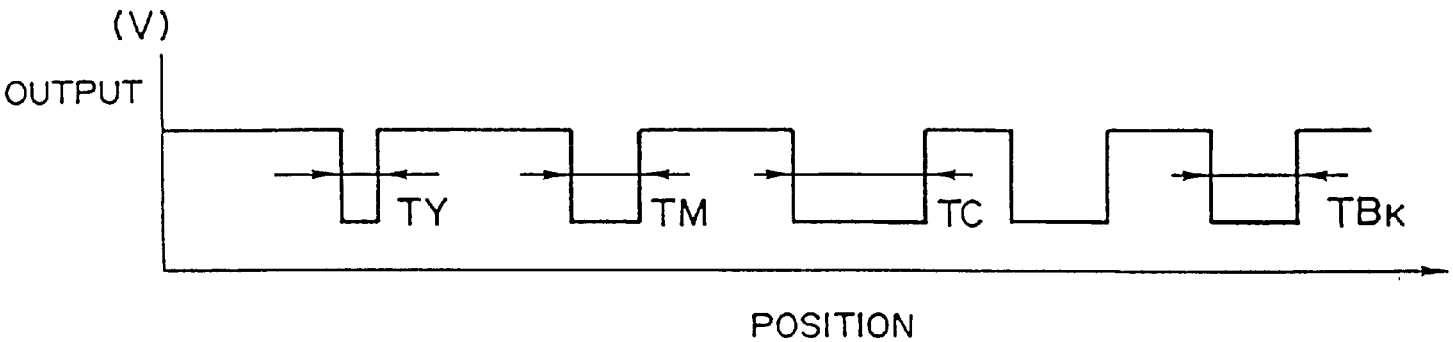
FIG. 28 illustrates an example of electrical signal detected according to the structural example shown in FIG. 27.

FIG. 28 illustrates an example of electrical signal detected when the carriage on which a recording head and a plurality of ink cartridges are mounted together is moved against a detector 321.

The carriage moves against the detector at a constant speed. When the tank Y for yellow ink passes, the detected signal Vout is at a low level Ov only for a time TY. Since this signal is detected in synchronism with the movement of the carriage, it is possible to recognize that it is a signal for the tank for yellow ink. Then, TM is detected for the magenta tank M. Similarly, thereafter, TC for the cyan, and TBk for the black are detected. The low level time for the detected signal has a length which corresponds to the ink remains. In this way, not only the presence or absence of ink in each of the ink tanks can be detected, but also, the ink remains can even be detected.

In this respect, the detection mechanism described in conjunction with FIG. 18 to FIG. 26 is capable of detecting the ink remains in the ink tank of such a structure where a recording head and an ink tank are formed together, in addition to being capable of detecting the ink remains in an ink cartridge. Further, it is possible for such a mechanism to detect the presence or absence of a recording head as well as a reading head arranged on a carriage.

Also, there is no longer needed any flexible cable by providing the main body of a recording apparatus with a sensor which is capable of detecting at least one of the carriage and recording head. At the same time, the presence and absence of the recording head and the ink tank can be detected. As a result, a small motor can be employed for driving the carriage, thus making it possible to provide a small ink jet recording apparatus.

Furthermore, it is possible to detect whether or not the carriage is in a normal operation at the same time.

In this respect, the present invention produces an excellent effect on the recording head or the recording apparatus which is provided with means (such as electrothermal transducers, laser beam, or the like) for generating the thermal energy to be utilized as the energy, thereby the change of state of ink is created to discharge ink for recording, because with this method, it is possible to achieve a highly densified and precise recording.

Regarding the typical structure and operational principle of such a method, it is preferable to adopt those which can be implemented using the fundamental principle disclosed in the specifications of U.S. Pat. Nos. 4,723,129 and 4,740,796. This method is applicable to the so-called on-demand type recording system as well as to a continuous type recording system. Particularly, it is suitable for the on-demand type because the principle is such that at least one driving signal, which provides a rapid temperature rise beyond a departure from nucleation boiling point in response to recording information, is applied to an electrothermal transducer disposed on a liquid (ink) retaining sheet or liquid passage whereby to cause the electrothermal transducer to generate thermal energy to produce film boiling on the thermoactive portion of the recording head; thus effectively leading to the resultant one to one formation of a bubble in the recording liquid (ink) for each of the driving signals. By the development and contraction of the bubble, the liquid (ink) is discharged through a discharging port to produce at least one droplet. The driving signal is preferably in the form of pulses because the development and contraction of the bubbles can be effectuated instantaneously, thus discharging the liquid (ink) with particularly quick responses. The driving signal in the form of pulses is preferably such as disclosed in the specifications of U.S. Pat. Nos. 4,463,359 and 4,345,262. In this respect, it is possible to execute an excellent recording in a better condition if the rate of the temperature increase of the heating surface is adopted as disclosed in the specification of U.S. Pat. No. 4,313,124.

The structure of the recording head may be as shown in each of the above-mentioned specifications wherein the structure is arranged to combine such discharge ports, liquid passages, and electrothermal transducers as disclosed in the specification (linear type liquid passage or right angle liquid passage). Here, there is also included in the present invention, a structure such as disclosed in the specifications of U.S. Pat. Nos. 4,558,333 and 4,459,600 wherein the portions thermally activated are arranged in a curved area. In addition, the present invention is effectively applicable to the structure disclosed in Japanese Laid-Open Application No. 59-123670 wherein a common slit is used as the discharging ports for plural electrothermal transducers, and to the structure disclosed in Japanese Patent Laid-Open Application No. 59-138461 wherein an aperture for absorbing pressure waves of the thermal energy is formed corresponding to the discharging ports. In other words, according to the present invention, recording can be executed reliably and efficiently irrespective of the modes of the recording head.

Moreover, as a recording head for which the present invention is effectively utilized, there is a full-line type recording head having a length corresponding to the maximum width of a medium which can be recorded by a recording apparatus. This full-line type head may be the one structured by combining a plurality of the recording heads disclosed in the above-mentioned specifications or a single full-line recording head which is integrally formed.

In addition, the present invention is effectively applicable to a replaceable chip type recording head which is electrically connected with the main body of the apparatus, and to which the ink is supplied when it is mounted in the main assembly; or to a cartridge type recording head having an ink tank integrally provided for the head itself.

Also, it is preferable to provide additionally means for recovering the recording head, and preliminarily auxiliary means as constituents of the recording apparatus according to the present invention because these additional means will contribute to making the effectiveness of the present invention more stabilized. To name them specifically, such constituents are capping means for the recording head, cleaning means, compression or suction means, preliminary heating means such as electrothermal transducers or heating elements other than such transducers or the combination of those types of elements, and the preliminary discharge mode which is adopted aside from the regular discharging for recording.

Also, regarding the kinds or numbers of the installed recording heads, it may be possible to adopt a recording head having only one head for a single color besides those having a plurality of heads for plural kinds of ink having different colors and concentrations. In other words, as the recording mode of the apparatus, for example, the present invention is extremely effective in applying it not only to a recording mode in which only main color such as black or the like is used, but also to an apparatus having at least one of a multi-color mode with ink of different colors, or a full-color mode using the mixture of the colors, irrespective of whether the recording heads are integrally structured or structured by a combination of plural recording heads.

Furthermore, in the embodiments according to the present invention set forth above, while the ink has been described as liquid, it may be an ink material which is solidified below the room temperature but liquefied at the room temperature. Since the ink is controlled within the temperature not lower than 30° C. and not higher than 70° C. in order to stabilize its viscosity for the provision of the stable discharge in general, the ink may be such that it can be liquefied when the applicable recording signals are given. In addition, while positively preventing the temperature rise due to the thermal energy by the use of such energy as an energy consumed for changing states of ink from solid to liquid, or using the ink which will be solidified when left intact for the purpose of preventing the ink from being evaporated, it may be possible to adopt for the present invention the use of an ink having a nature of being liquefied only by the application of thermal energy, such as an ink capable of being discharged as ink liquid by enabling itself to be liquefied anyway when the thermal energy is given in accordance with recording signals, and an ink which will have already begun solidifying itself by the time it reaches a recording medium. In such a case, it may be possible to retain the ink in the form of liquid or solid in the recesses or through holes of a porous sheet such as disclosed in Japanese Patent Laid-Open Application No. 54-56847 or 60-71260 in order to enable the ink to face the electrothermal transducers. For the present invention, the most effective method applicable to the various kinds of ink described above is the method in which the aforesaid film boiling can be implemented.

Furthermore, as the mode of the recording apparatus according to the present invention, it may be possible to adopt a copying apparatus combined with a reader in addition to the image output terminal which is integrally or independently provided for a word processor, computer, or other information processing apparatus. Also, it may be possible to adopt among others a mode of a facsimile apparatus having transmission and reception functions.

What is claimed is:

1. An ink tank for use in an ink jet recording apparatus, said ink tank containing ink to be discharged from a recording head, comprising:

an ink supply section for supplying ink out of said ink tank, said ink supply section being provided at a predetermined inner wall of a plurality of inner walls constituting said ink tank; and inclined elements provided on a portion of a the predetermined inner wall of a the plurality of inner walls constituting said ink tank, said inclined elements being inclined with respect to each other, light being reflected by one of said inclined elements to another of said inclined elements and said other element reflecting the light outside of said ink tank, wherein an amount of light reflected by said inclined elements varies in accordance with a presence or absence of ink at a position of at least one of said inclined elements in said ink tank.

2. An ink tank according to claim 1, wherein one of said other inclined elements reflects the light in a direction substantially opposed to an inclined direction of the light.

3. An ink tank according to claim 1, wherein the amount of light reflected by said inclined elements in a case where ink is absent at a position of at least one of said inclined elements is greater than that in a case where ink is present at the position of at least one said inclined elements.

4. An ink tank according to claim 1, wherein said inclined elements comprise two inclined faces and the two inclined faces join one another at a predetermined angle.

5. An ink tank according to claim 1, wherein said inclined elements are spaced from another inner wall contacting the predetermined inner wall.

6. An ink jet recording apparatus comprising:

a main body;

a carriage movable in predetermined directions and detachably mounting a recording head, which is provided with discharge ports for discharging ink, and an ink tank, said ink tank comprising an ink supply section for supplying ink out of said ink tank, said ink supply section being provided at a predetermined inner wall of a plurality of inner walls constituting said ink tank, and inclined elements provided on a portion of a the predetermined inner wall of the plurality of inner walls constituting said ink tank, said inclined elements being inclined with respect to each other, light being reflected by one of said inclined elements to another of said inclined elements and said other element reflecting the light outside of said ink tank, wherein an amount of light reflected by said inclined elements varies in accordance with a presence or absence of ink at a position of at least one of said inclined elements in said ink tank; and a sensor for detecting the presence or absence of at least one of said carriage, said recording head and said ink tank, wherein said sensor is provided on said main body and positioned within a movable range of said carriage, and wherein said sensor comprises a light emitting unit for emitting the light from outside of said ink tank and a photodetecting unit for receiving the reflected light.

7. An ink jet recording apparatus according to claim 6, further comprising:

a controller for determining whether the movement of said carriage is normal or abnormal, and whether at least one of said recording head and said ink tank is installed by receiving from said sensor a detected signal which is sensed in synchronism with movement of said carriage.

8. An ink jet recording apparatus according to claim 7, wherein said carriage mounts a plurality of recording heads and wherein each recording head is assigned a different color of the ink.

9. An ink jet recording apparatus according to claim 8, wherein each recording head comprises electrothermal transducers for generating thermal energy for discharging the ink.

10. An ink jet recording apparatus according to claim 9, wherein each recording head discharges the ink from the discharge ports by utilizing film boiling generated in the ink by the thermal energy generated by said electrothermal transducers.

11. An ink jet recording apparatus according to claim 6, wherein said carriage mounts a plurality of recording heads and wherein each recording head is assigned a different color of the ink.

12. An ink jet recording apparatus according to claim 11, wherein each recording head comprises electrothermal transducers for generating thermal energy for discharging the ink.

13. An ink jet recording apparatus according to claim 12, wherein each recording head discharges the ink from the discharge ports by utilizing film boiling generated in the ink by the thermal energy generated by said electrothermal transducers.

14. An ink jet recording apparatus according to claim 6, wherein said recording head comprises electrothermal transducers for generating thermal energy for discharging the ink.

15. An ink jet recording apparatus according to claim 14, wherein said recording head discharges the ink from the discharge ports by utilizing film boiling generated in the ink by the thermal energy generated by said electrothermal transducers.

16. An ink jet recording apparatus according to claim 6, wherein one of said other inclined elements of said ink tank reflects the light in a direction substantially opposed to an inclined direction of the light.

17. An ink jet recording apparatus according to claim 6, wherein the amount of light reflected by said inclined elements in a case where ink is absent at a position of at least one of said inclined elements is greater than that in a case where ink is present at the position of at least one said inclined elements.

18. An ink jet recording apparatus according to claim 6, wherein said inclined elements comprise two inclined faces and the two inclined faces join one another at a predetermined angle.

19. An ink jet recording apparatus according to claim 6, wherein said inclined elements are spaced from another inner wall contacting the predetermined inner wall.

20. A method for determining an ink amount in an ink tank in an ink jet recording apparatus, said method comprising the steps of:

emitting light from outside of the ink tank;

reflecting the light by one of inclined elements of the ink tank, the inclined elements being inclined with respect to each other and being provided on a portion of a predetermined inner wall of a plurality of inner walls constituting the ink tank, an ink supply section for supplying ink out of the ink tank being provided at the predetermined inner wall;

detecting the light reflected by the inclined elements; and determining the ink amount in the ink tank in accordance with an amount of the light detected in said detecting step, wherein the amount of the light reflected by the inclined elements varies in accordance with a presence or absence of ink at a position of at least one of the inclined elements in the ink tank.

21. An ink amount determining method according to claim 20, wherein the amount of light reflected by the inclined elements in a case where ink is absent at a position of at least one of the inclined elements is greater than that in a case where ink is present at the position of at least one the inclined elements.

22. An ink amount determining method according to claim 20, wherein the inclined elements comprise two inclined faces and the two inclined faces join one another at a predetermined angle.

23. An ink amount determining method according to claim 20, wherein the inclined elements are spaced from another inner wall contacting the predetermined inner wall.

24. An ink tank for containing ink and for use in an ink jet recording apparatus, comprising:

an ink supply section for supplying ink out of said ink tank, said ink supply section being provided at a predetermined wall constituting said ink tank; and inclined elements provided inside of said predetermined wall of said ink tank, said inclined elements being inclined with respect to each other, light being reflected by one of said inclined elements to another of said inclined elements and said other of said inclined elements reflecting the light outside of said ink tank, wherein an amount of light reflected by said inclined elements varies in accordance with a presence or absence of ink at a position of at least one of said inclined elements in said ink tank, and wherein said inclined elements are spaced from another wall contacting said predetermined wall.

25. An ink tank according to claim 24, wherein said inclined elements are formed integratedly with said ink tank.

26. An ink tank according to claim 24, wherein said inclined elements are formed of a transparent material.

27. An ink tank for containing ink and for use in an ink jet recording apparatus, comprising:

an ink supply section for supplying ink out of said ink tank, said ink supply section being provided at a predetermined wall constituting said ink tank; and inclined elements provided inside of said predetermined wall of said ink tank, said inclined elements being inclined with respect to each other, light being reflected by one of said inclined elements to another of said inclined elements and said other of said inclined elements reflecting the light outside of said ink tank, wherein an amount of light reflected by said inclined elements varies in accordance with an amount of ink at a position of at least one said inclined elements in said ink tank, and wherein said inclined elements are spaced from another wall contacting said predetermined wall.

* * * * *

UNITED STATES PATENT AND TRADEMARK OFFICE

CERTIFICATE OF CORRECTION

PATENT NO. : 6,729,711 B1
DATED : May 4, 2004
INVENTOR(S) : Hashimoto et al.

It is certified that error appears in the above-identified patent and that said Letters Patent is hereby corrected as shown below:

Title page,
Item [56], References Cited, FOREIGN PATENT DOCUMENTS, "362021549 A" should read -- 62-21549 --.

Column 2,
Line 5, "heavier that much," should read -- that much heavier, --.

Column 4,
Line 62, "Jet" should read -- jet --.

Column 6,
Line 16, "tube It." should read -- tube 1t. --.

Column 9,
Line 56, "care" should read -- are --.

Column 11,
Line 34, "is-found" should read -- is found --.
Line 62, "become" should read -- becomes --.

Column 15,
Lines 57 and 58, "remains" should read -- remaining --.

Column 19,
Line 64, "a" should be deleted.

Column 20,
Line 14, "one" should read -- one of --.
Line 30, "a" (second occurrence) should be deleted.

Column 21,
Line 33, "one" should read -- one of --.

UNITED STATES PATENT AND TRADEMARK OFFICE

CERTIFICATE OF CORRECTION

PATENT NO. : 6,729,711 B1
DATED : May 4, 2004
INVENTOR(S) : Hashimoto et al.

It is certified that error appears in the above-identified patent and that said Letters Patent is hereby corrected as shown below:

Column 22,
Line 7, "one" should read -- one of --.

Signed and Sealed this

Twenty-eighth Day of December, 2004

JON W. DUDAS
*Director of the United States Patent and Trademark Office*